US010248049B2

(12) United States Patent
Eto

(10) Patent No.: US 10,248,049 B2
(45) Date of Patent: Apr. 2, 2019

(54) TONER CASE AND IMAGE FORMING APPARATUS

(71) Applicant: KYOCERA Document Solutions Inc., Osaka (JP)

(72) Inventor: Daisuke Eto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/451,785

(22) Filed: Mar. 7, 2017

(65) Prior Publication Data

US 2018/0059577 A1 Mar. 1, 2018

(30) Foreign Application Priority Data

Aug. 26, 2016 (JP) ..... 2016-165715

(51) Int. Cl.
*G03G 15/08* (2006.01)

(52) U.S. Cl.
CPC ..... *G03G 15/0889* (2013.01); *G03G 15/0872* (2013.01); *G03G 15/0875* (2013.01); *G03G 15/0891* (2013.01); *G03G 2215/085* (2013.01); *G03G 2215/0827* (2013.01); *G03G 2215/0833* (2013.01); *G03G 2221/1657* (2013.01)

(58) Field of Classification Search
CPC ..... G03G 15/0889; G03G 15/0891; G03G 15/0836; G03G 15/087; G03G 21/1647
See application file for complete search history.

(56) References Cited

U.S. PATENT DOCUMENTS 7,283,773 B2 10/2007 Amano et al.
7,499,666 B2 3/2009 Amano et al.
7,796,924 B2 9/2010 Amano et al.
9,436,124 B2 9/2016 Eto
2005/0169676 A1* 8/2005 Oda ..... G03G 15/0875 399/262
2007/0059038 A1* 3/2007 Shiraki ..... G03G 21/1647 399/119

(Continued)

FOREIGN PATENT DOCUMENTS

EP 2980652 A1 2/2016
JP 2006-030303 A 2/2006

OTHER PUBLICATIONS

The extended European search report issued by the European Patent Office on Aug. 18, 2017, which corresponds to European Patent Application No. 17158623.3-1568 and is related to U.S. Appl. No. 15/451,785.

*Primary Examiner* — David M. Gray
*Assistant Examiner* — Laura Roth
(74) *Attorney, Agent, or Firm* — Studebaker & Brackett PC

(57) ABSTRACT

A toner case includes a case main body, a rotating member, a transmitting member and a cover. The case main body contains a toner. The rotating member is disposed in the case main body and is rotatable around a rotation axis. The transmitting member rotates along an outer face of a side wall of the case main body on one side in a direction of the rotation axis so as to transmit a rotation to the rotating member. The cover covers at least a portion of the transmitting member. The transmitting member has a movable part which moves as the transmitting member rotates. The cover has a hole part through which the movable part is exposed.

3 Claims, 24 Drawing Sheets

(56) References Cited

U.S. PATENT DOCUMENTS

| | | | | |
|---|---|---|---|---|
| 2007/0122165 | A1* | 5/2007 | Igarashi | G03G 15/0822 399/12 |
| 2008/0170890 | A1 | 7/2008 | Nishimura et al. | |
| 2013/0051851 | A1* | 2/2013 | Fukamachi | G03G 21/1821 399/113 |
| 2017/0185002 | A1* | 6/2017 | Jang | G03G 15/0862 |

* cited by examiner

TONER CASE AND IMAGE FORMING APPARATUS

INCORPORATION BY REFERENCE

This application is based on and claims the benefit of priority from Japanese Patent application No. 2016-165715 filed on Aug. 26, 2016, which is incorporated by reference in its entirety.

BACKGROUND

The present disclosure relates to a toner case and an image forming apparatus including the toner case.

In an image forming apparatus such as a printer, a copying machine and a multifunctional peripheral, a toner (developer) is supplied to an image carrier, such as a photosensitive drum, from a development device to form a toner image. The toner used for the toner image forming is usually replenished to the development device from a toner case.

For instance, there is a toner case having a case main body in which a toner is contained and a rotating member which is disposed in the case main body.

SUMMARY

In accordance with an aspect of the present disclosure, a toner case includes a case main body, a rotating member, a transmitting member and a cover. The case main body contains a toner. The rotating member is disposed in the case main body and is rotatable around a rotation axis. The transmitting member rotates along an outer face of a side wall of the case main body on one side in a direction of the rotation axis so as to transmit a rotation to the rotating member. The cover covers at least a portion of the transmitting member. The transmitting member has a movable part which moves as the transmitting member rotates. The cover has a hole part through which the movable part is exposed.

In accordance with an aspect of the present disclosure, an image forming apparatus includes the above toner case and an attachment member to which the toner case is attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First, an entire structure of a printer 1 (an image forming apparatus) will be described.

Figure 1:
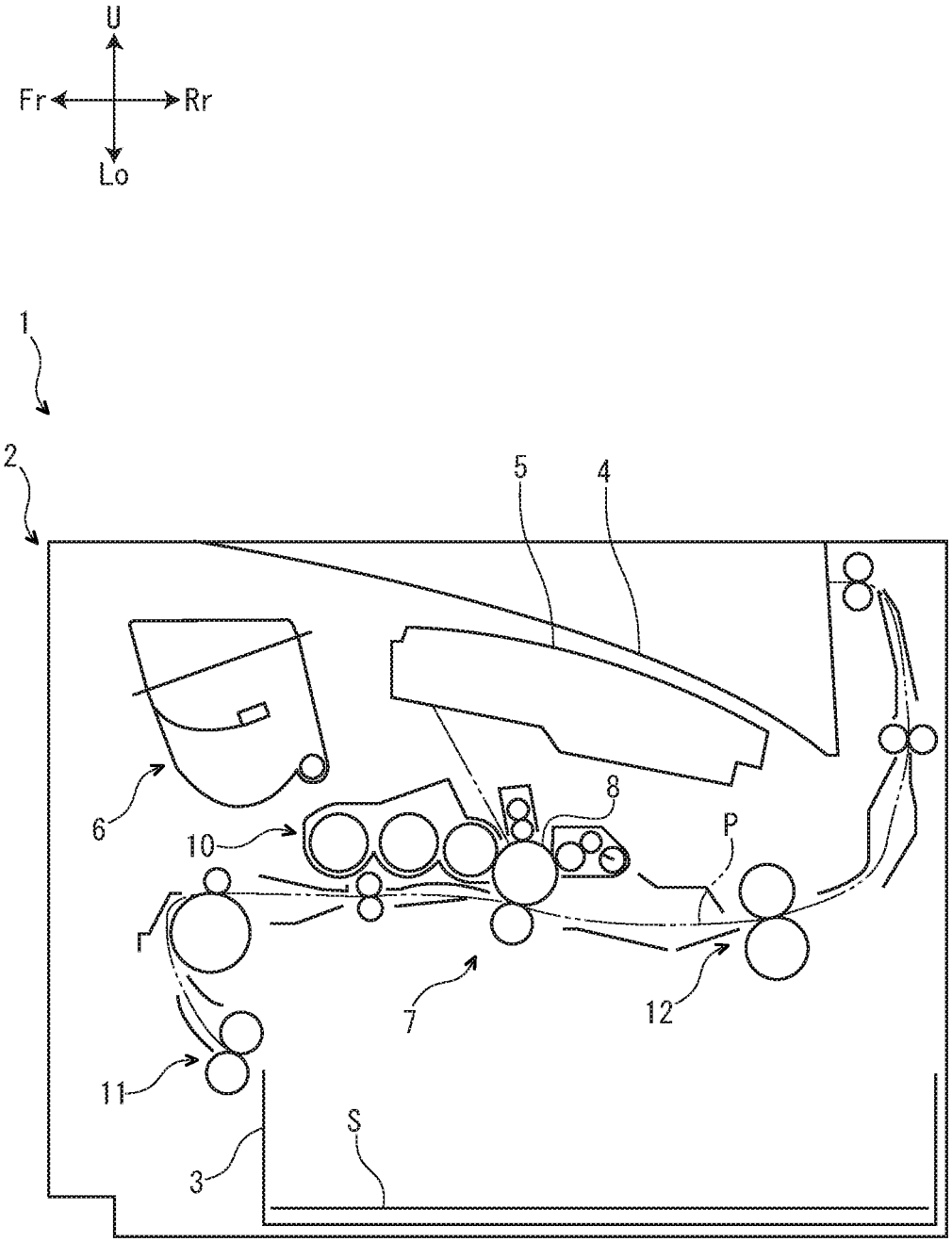
FIG. 1 is a schematic view schematically showing a printer according to an embodiment of the present disclosure.

In the following description, a left side in FIG. 1 shows a front side of the printer 1 for convenience of explanation. Arrows Fr, Rr, L, R, U and Lo suitably marked in each figure respectively shows the front side, a rear side, a left side, a right side, an upper side and a lower side of the printer 1.

With reference to FIG. 1, the printer 1 includes a box-shaped printer main body 2 (an apparatus main body). In a lower part of the printer main body 2, a sheet feeding cartridge 3 which stores sheets S (recording mediums) is installed. On an upper face of the printer main body 2, an ejected sheet tray 4 is provided. In an upper part of the printer main body 2, an exposure device 5 is installed under the ejected sheet tray 4. In the upper part of the printer main body 2, a toner container 6 (a toner case) is installed in front of the exposure device 5.

Inside of the printer main body 2, a conveying path P for the sheet S is formed. At an upstream side end portion of the conveying path P, a sheet feeding part 11 is provided. At a middle portion of the conveying path P, an image forming part 7 is provided. The image forming part 7 has a photosensitive drum 8 (an image carrier) and a development device 10 (an attachment member). At a downstream side portion of the conveying path P, a fixing device 12 is provided.

Next, the operation of forming an image by the printer 1 having such a configuration will be described.

First, a laser (refer to a two-dotted line in FIG. 1) from the exposure device 5 forms an electrostatic latent image on the photosensitive drum 8. The electrostatic latent image on the photosensitive drum 8 is developed by the development device 10 to a toner image. In this manner, the image forming operation is completed.

On the other hand, the sheet fed from the sheet feeding cartridge 3 by the sheet feeding part 11 is conveyed to the image forming part 7 in a suitable timing for the above-mentioned image forming operation. Then, in the image forming part 7, the toner image is transferred on the sheet S from the photosensitive drum 8. The sheet S on which the toner image is transferred is conveyed in a downstream direction along the conveying path P and then enters the fixing device 12. Then, the toner image is fixed on the sheet S in the fixing device 12. The sheet S on which the toner image is fixed is ejected on the ejected sheet tray 4 from the downstream side end portion of the conveying path P.

Next, the toner container 6 will be described in more detail.

Figure 2:
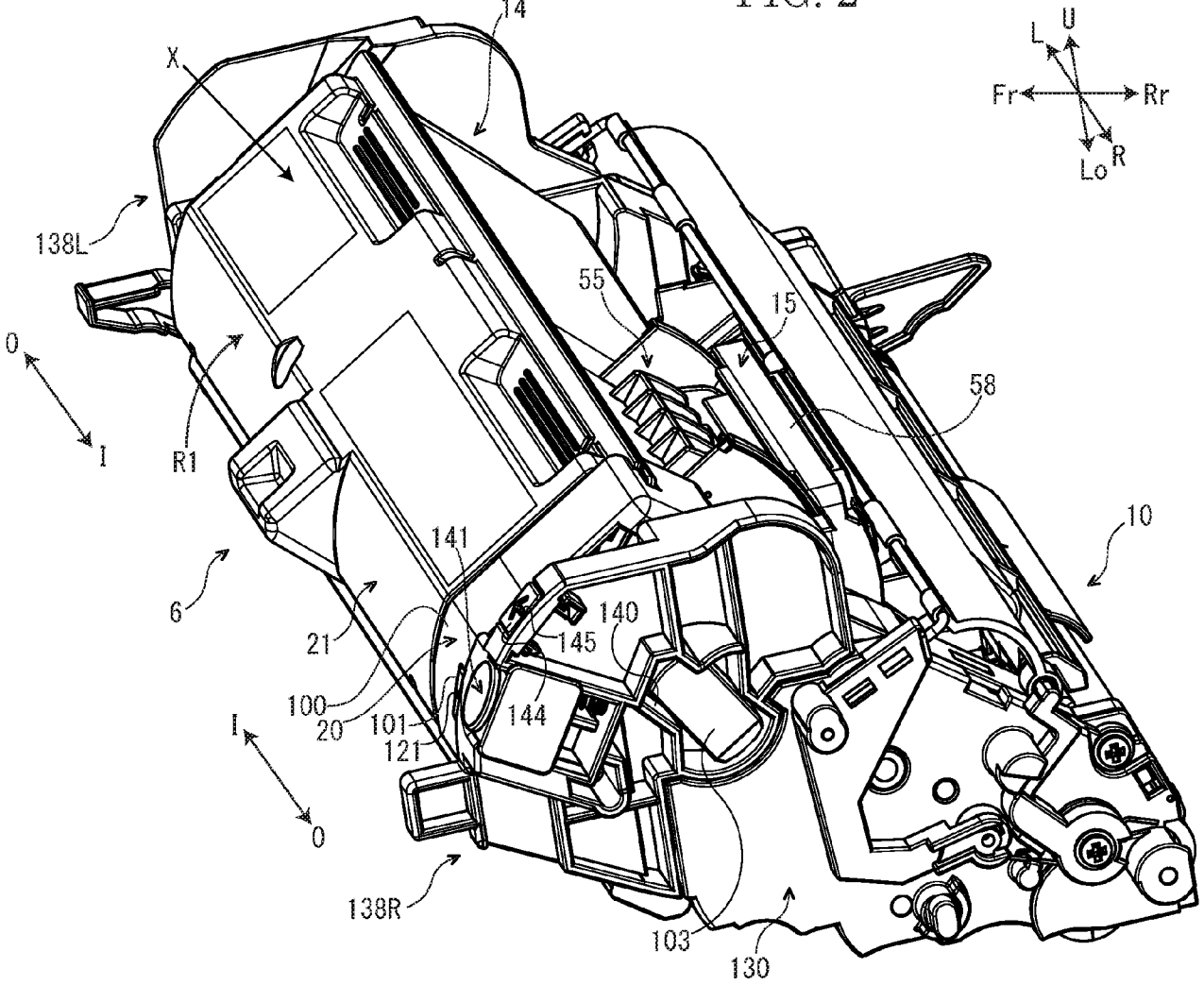
FIG. 2 is a perspective view showing a state where a toner container is positioned in a locking release position, in the printer according to the embodiment of the present disclosure.

An arrow I suitably marked in FIG. 2 and following figures shows an inner side in a left and right direction (a side close to a center of the toner container 6 in the left and right direction). An arrow O suitably marked in FIG. 2 and following figures shows an outer side in the left and right direction (a side separating from the center of the toner container 6 in the left and right direction).

Figure 3:
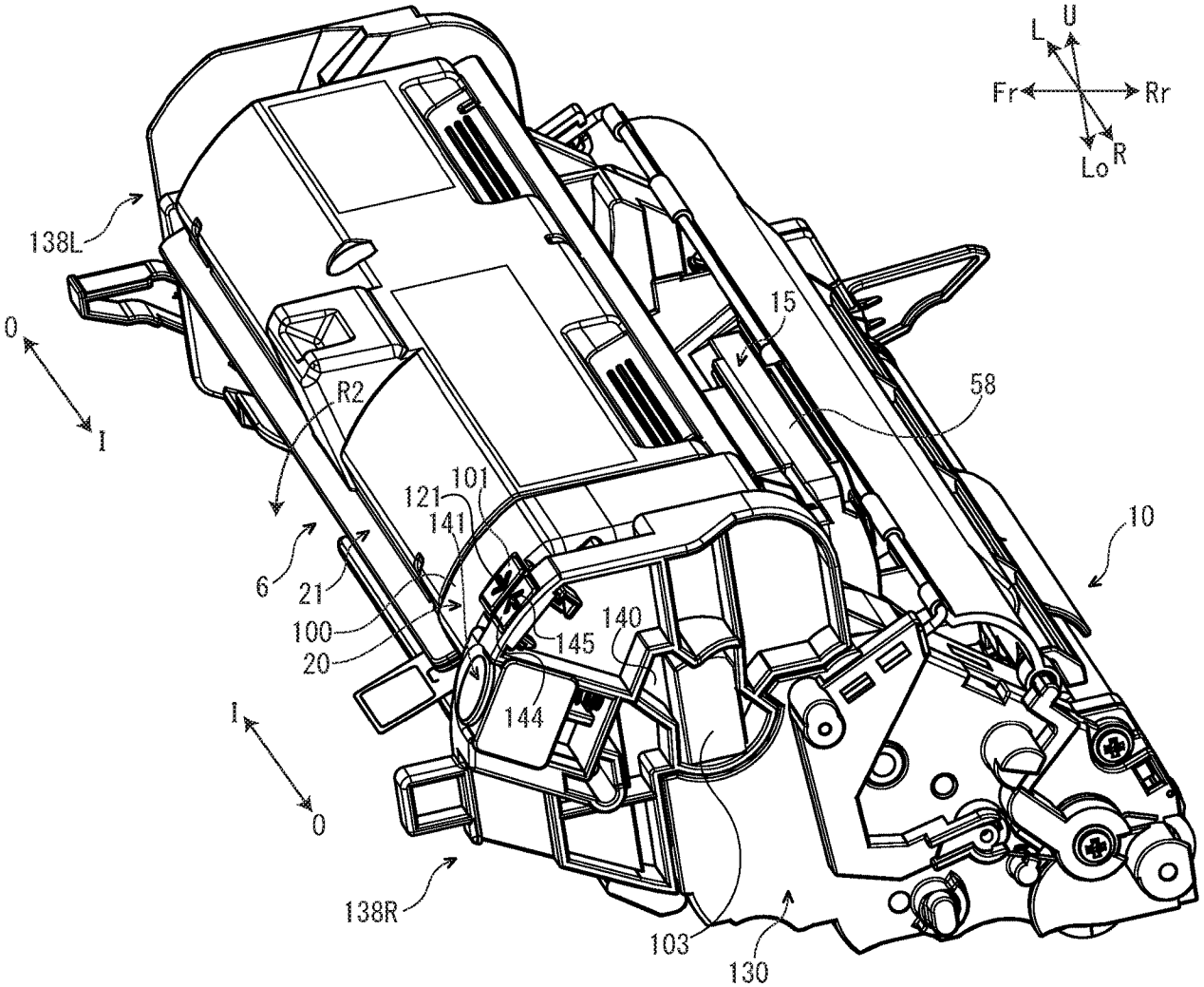
FIG. 3 is a perspective view showing a state where the toner container is positioned in a locking position, in the printer according to the embodiment of the present disclosure.

With reference to FIG. 2, FIG. 3 and other figures, the toner container 6 is attached to the development device 10. An arrow X suitably marked in FIG. 2 and following figures shows an attachment direction of the toner container 6 to the development device 10 (hereinafter, called as "an attachment direction X").

The toner container 6 is configured to rotate between a locking release position (refer to FIG. 2) and a locking position (refer to FIG. 3) in a state where the toner container 6 is attached to the development device 10. In the following description, descriptions showing directions, such as the upper side and the lower side, are based on a state where the toner container 6 is in the locking position. An arrow R1 suitably marked in FIG. 2 and the following figures shows a rotation direction of the toner container 6 from the locking release position to the locking position (hereinafter, called as "a first rotation direction R1"). On the other hand, an arrow R2 suitably marked in FIG. 3 and the following figures shows a rotation direction of the toner container 6 from the locking position to the locking release position (hereinafter, called as "a second rotation direction R2"). The first rotation direction R1 and the second rotation direction R2 are perpendicular to the left and right direction.

Figure 4:
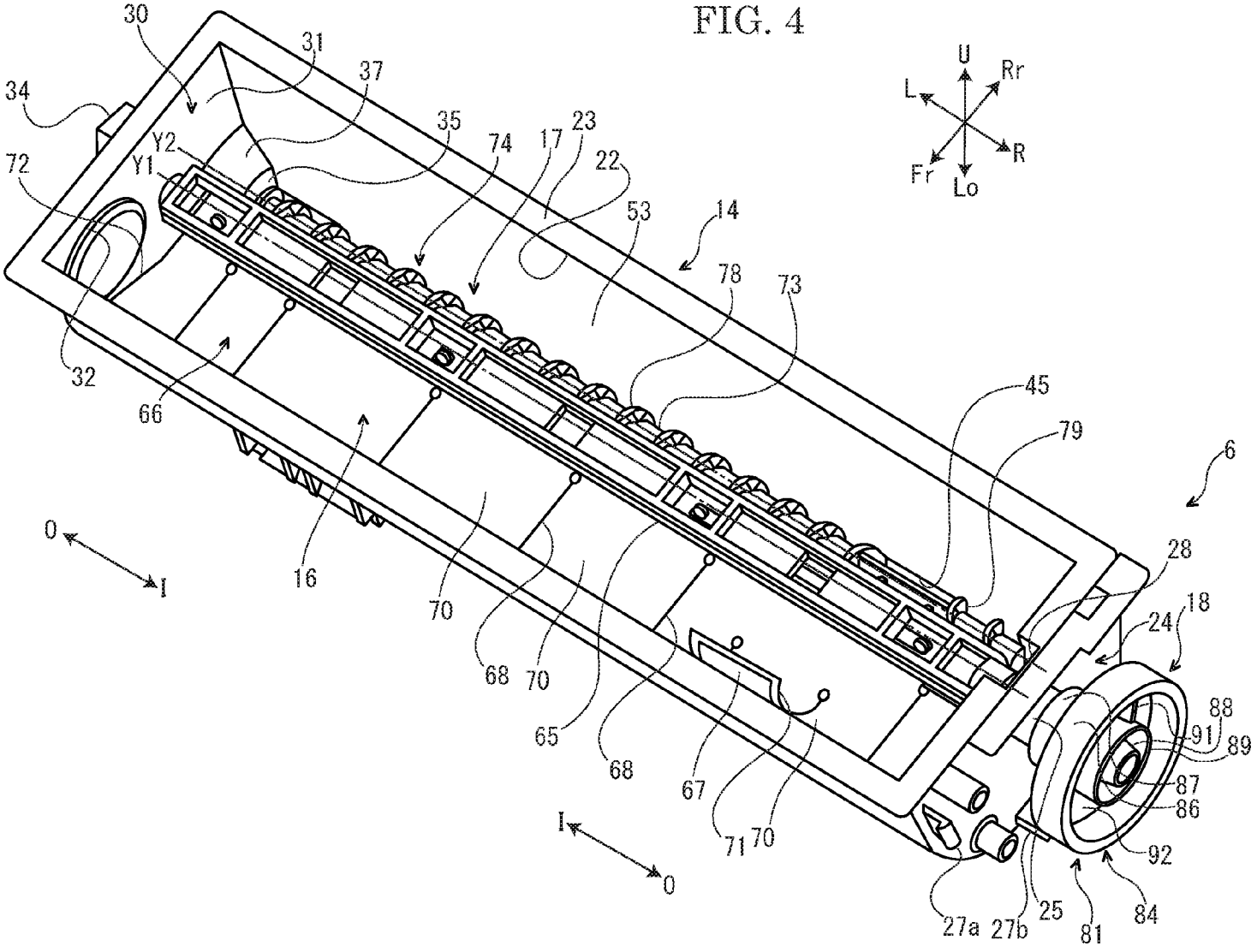
FIG. 4 is a perspective view showing a case main body, a discharge shutter, an agitating paddle, a conveying screw and a rotation transmitting mechanism, in the toner container according to the embodiment of the present disclosure.
Figure 5:
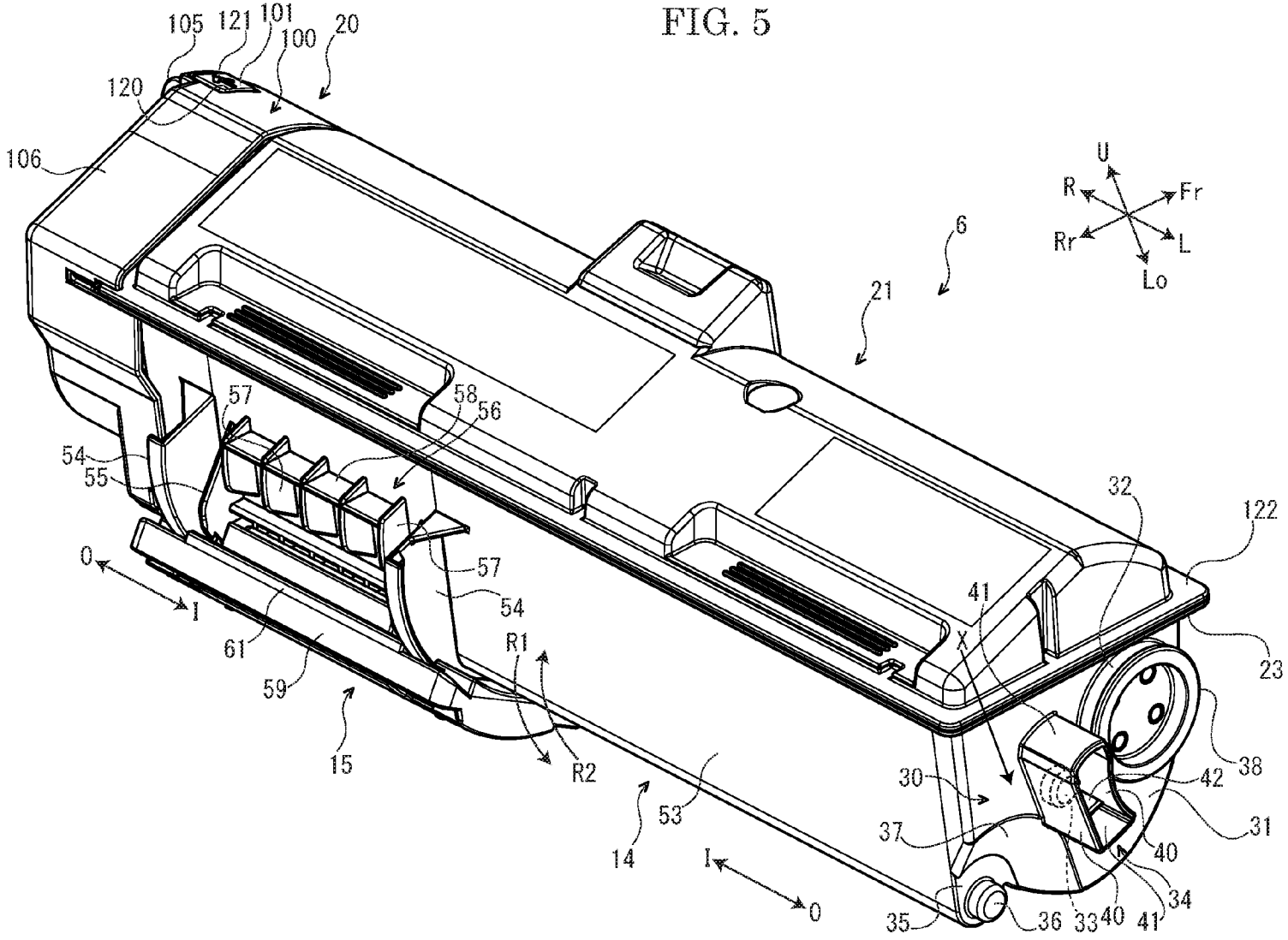
FIG. 5 is a rear upper side perspective view showing the toner container according to the embodiment of the present disclosure.

With reference to FIG. 4, FIG. 5 and other figures, the toner container 6 includes a case main body 14, a discharge shutter 15 disposed on the right lower side of the case main body 14, an agitating paddle 16 (a first rotating member) and a conveying screw 17 (a second rotating member) which are disposed in the case main body 14, a rotation transmitting mechanism 18 provided on the right side of the case main body 14, a cover 20 which covers the rotation transmitting mechanism 18 and a lid member 21 provided on the upper side of the case main body 14. The cover 20 and the lid member 21 are not shown in FIG. 4. Hereinafter, the above members which constitutes the toner container 6 will be described in the above described order.

First, the case main body 14 of the toner container 6 will be described.

With reference to FIG. 4 and other figures, the case main body 14 is formed into a box-like shape elongated in the left and right direction. That is, in the present embodiment, the left and right direction is the longitudinal direction of the case main body 14. In the case main body 14, a toner (a developer) of black color is contained. On an upper face of the case main body 14, an opening 22 is formed. The case main body 14 has a case main body side flange 23 around the opening 22.

Figure 6:
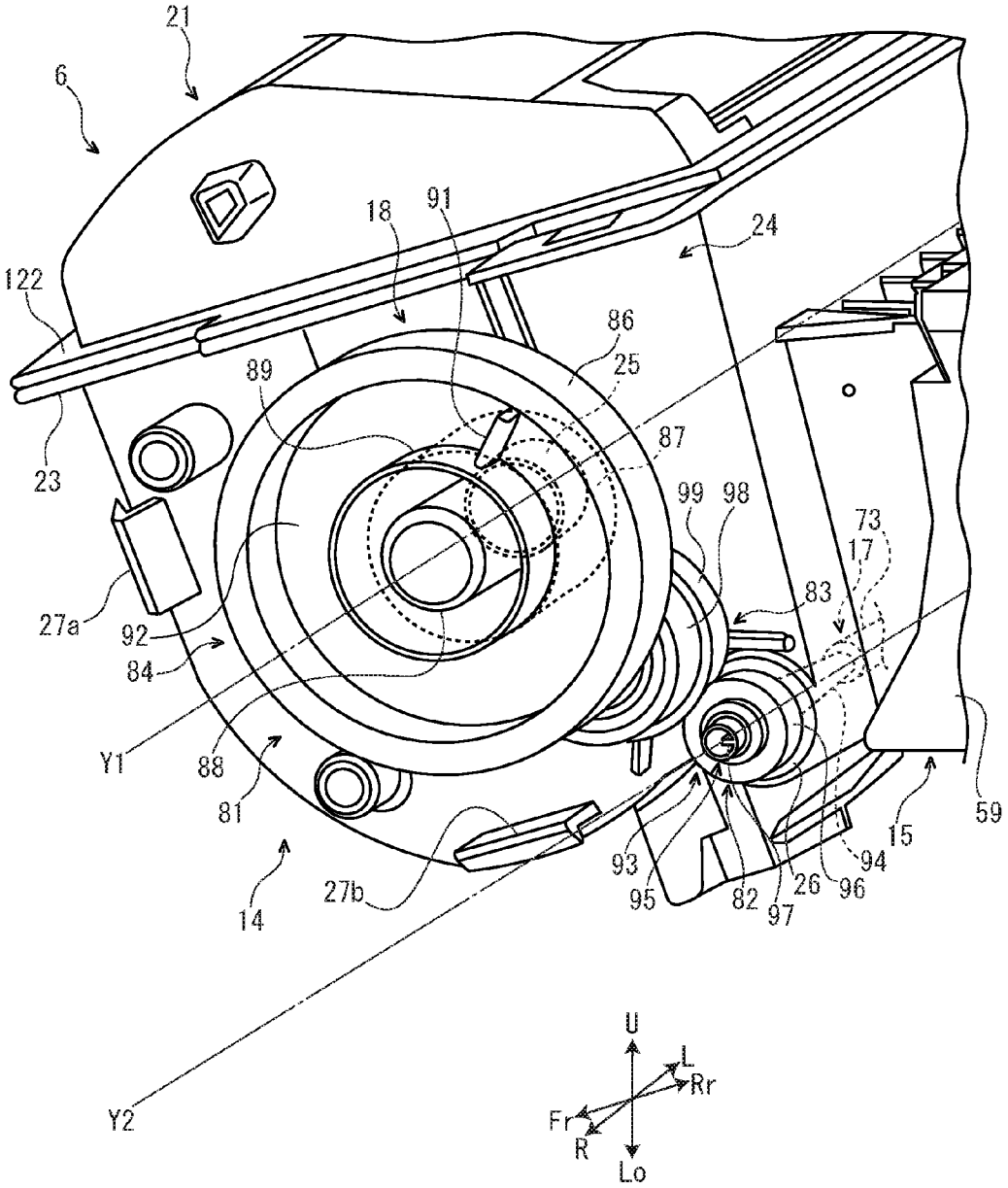
FIG. 6 is a right rear side perspective view showing a right side wall of the case main body and its peripheral portions, in the toner container according to the embodiment of the present disclosure.

With reference to FIG. 6 and other figures, a first rotatably supporting part 25 of a cylindrical shape protrudes from a center portion of an outer face of a right side wall 24 (a side wall in the left and right direction) of the case main body 14. The first rotatably supporting part 25 communicates an inside and an outside of the case main body 14. A second rotatably supporting part 26 of a cylindrical shape protrudes from a rear lower corner portion of the outer face of the right side wall 24. The second rotatably supporting part 26 communicates the inside and the outside of the case main body 14. An engagement projection 27*a* protrudes from a front end portion of the outer face of the right side wall 24 of the case main body 14. An engagement projection 27*b* protrudes from a lower end portion of the outer face of the right side wall 24 of the case main body 14.

Figure 7:
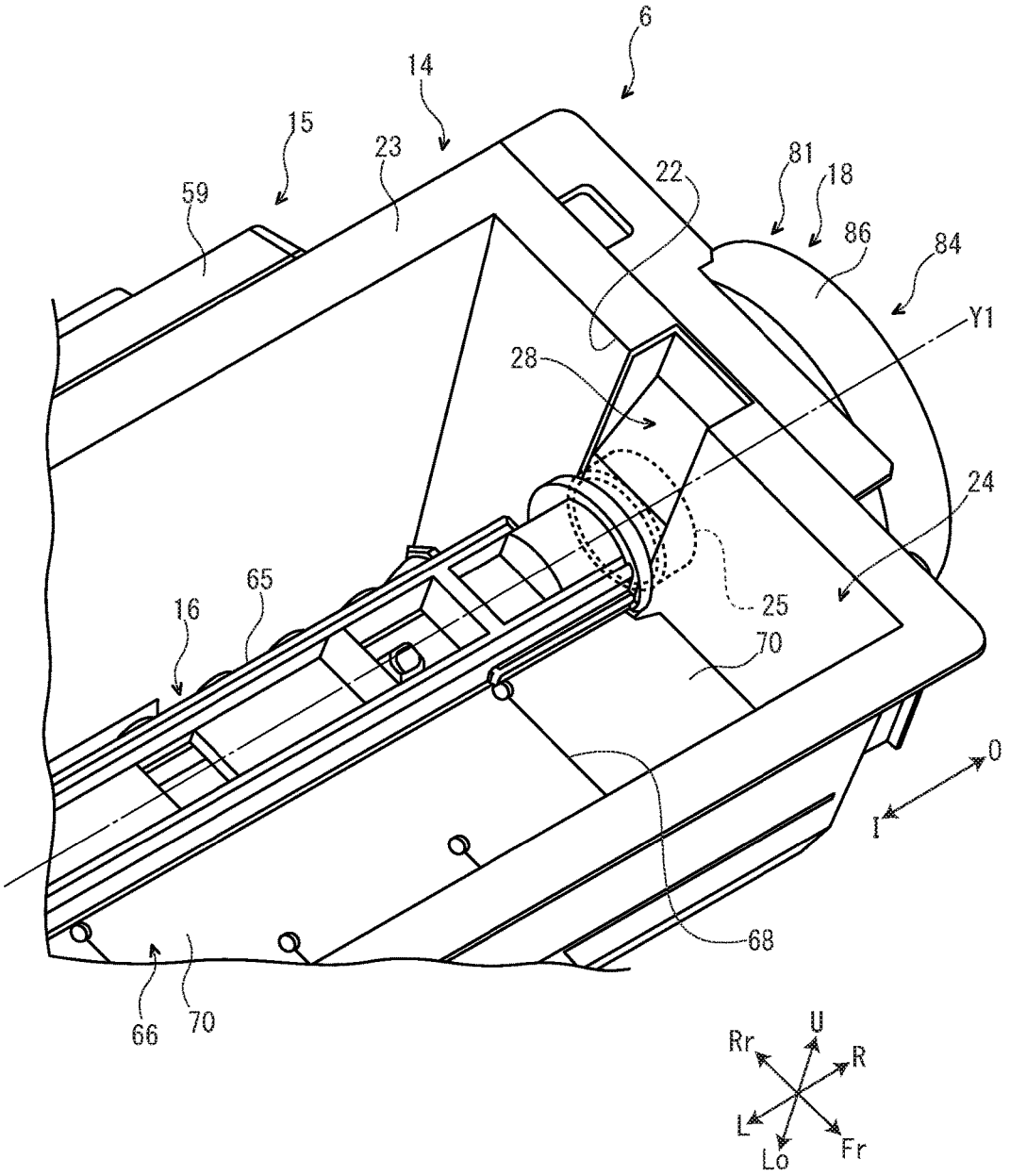
FIG. 7 is a left upper side perspective view showing the right side wall of the case main body and the peripheral portions, in the toner container according to the embodiment of the present disclosure.

With reference to FIG. 7 and other figures, on an inner face of the right side wall 24 of the case main body 14, an insertion groove 28 is formed so as to extend from the upper side (a side of the opening 22) to the lower side (a side of the first rotatably supporting part 25). A width in the left and right direction of a lower portion of the insertion groove 28 becomes narrower from the upper side (the side of the opening 22) to the lower side (the side of the first rotatably supporting part 25). An upper end (an end on the side of the opening 22) of the insertion groove 28 is opened in the case main body side flange 23.

With reference to FIG. 5 and other figures, a left side wall 30 (a side wall in the left and right direction) of the case main body 14 has a base part 31, a toner filling port 32, a first bearing part 33, a guide part 34, a recess part 35, a second bearing part 36 and a connecting part 37. The toner filling port 32 protrudes leftward (outward in the left and right direction) from a front upper portion of the base part 31. The first bearing part 33 protrudes leftward (outward in the left and right direction) from a rear portion of the base part 31. The guide part 34 is formed around the first bearing part 33. The recess part 35 is recessed rightward (inward in the left and right direction) with respect to the base part 31. The second bearing part 36 protrudes leftward (outward in the left and right direction) from the recess part 35. The connecting part 37 connects the base part 31 and the recess part 35.

The base part 31 of the left side wall 30 of the case main body 14 is shaped into a flat plate. The base part 31 is formed perpendicular to the left and right direction. In other words, the base part 31 is formed along a plane crossing to the left and right direction (a plane not in parallel to the left and right direction).

The toner filling port 32 of the left side wall 30 of the case main body 14 is shaped into a cylinder. The toner filling port 32 communicate the inside and the outside of the case main body 14 so that the inside of the case main body 14 can be filled with the toner through the toner filling port 32. The toner filling port 32 is closed with a circular cap 38.

Figure 8:
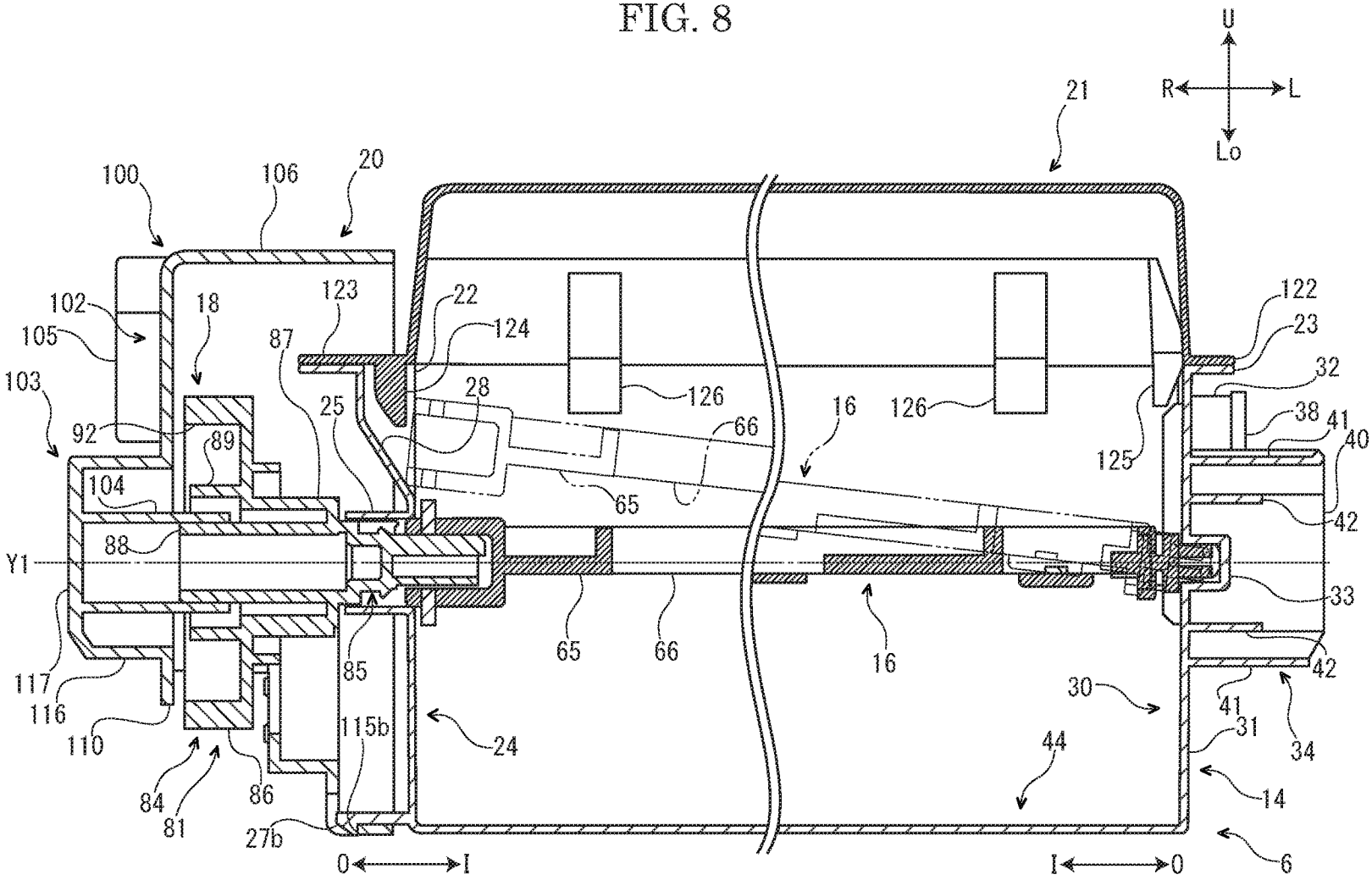
FIG. 8 is a sectional view showing the toner container according to the embodiment of the present disclosure.

With reference to FIG. 8 and other figures, the first bearing part 33 of the left side wall 30 of the case main body 14 is integrally formed with the base part 31. The first bearing part 33 is shaped into a bottomed cylinder whose left end portion (an outer end portion in the left and right direction) is closed. An inner face of the left side wall 30 of the case main body 14 is not provided with an insertion groove extending from the upper side (a side of the opening 22) to the lower side (a side of the first bearing part 33).

With reference to FIG. 5 and other figures, the guide part 34 of the left side wall 30 of the case main body 14 protrudes leftward (outward in the left and right direction) from the base part 31 and the connecting part 37. The guide part 34 is integrally formed with the base part 31 and the connecting part 37. The guide part 34 is elongated in the attachment direction X. The guide part 34 is formed between the toner filling port 32 and the recess part 35. The guide part 34 is shaped into a tube so as to surround the first bearing part 33. The guide part 34 is integrally formed with the first bearing part 33.

Figure 9:
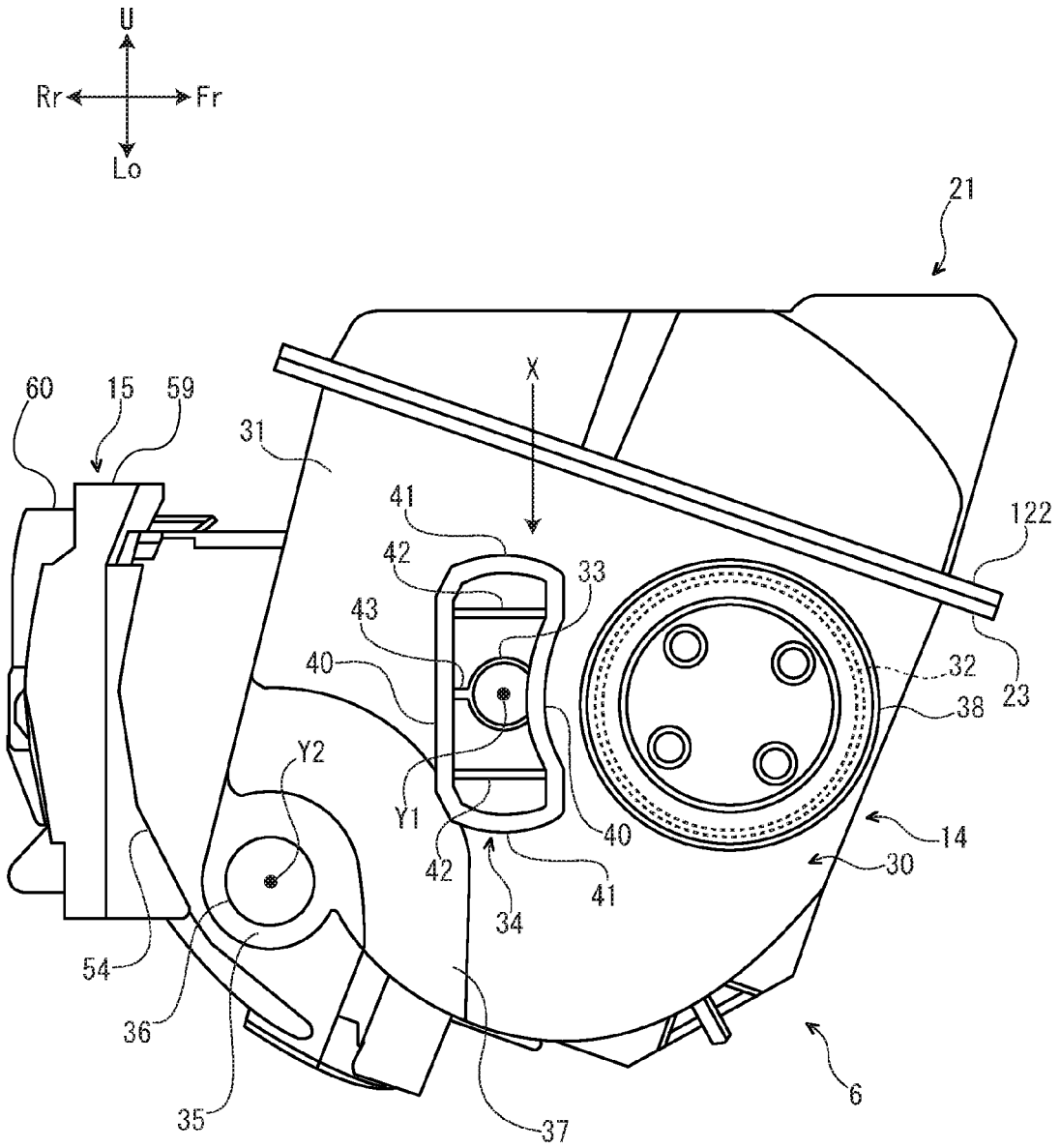
FIG. 9 is a side view showing a left side wall of the case main body and its peripheral portions, in the toner container according to the embodiment of the present disclosure.

With reference to FIG. 9 and other figures, the guide part 34 of the left side wall 30 of the case main body 14 has a pair of front and rear facing plates 40 facing each other and a pair of upper and lower connecting plates 41 which connect both upper ends and lower ends of the pair of front and rear facing plates 40. Upper portions and lower portions of the pair of facing plates 40 are connected by a pair of upper and lower reinforcing ribs 42. A center portion in an upper and lower direction of the front facing plate 40 curves in an arc shape along outer circumferential faces of the toner filling port 32 and the cap 38. To the center portion (the curved portion) in the upper and lower direction of the front facing plate 40, the first bearing part 33 is directly connected. The rear facing plate 40 is shaped into a flat plate along the attachment direction X. To a center portion in the upper and lower direction of the rear facing plate 40, the first bearing part 33 is connected via a connecting rib 43.

Figure 10:
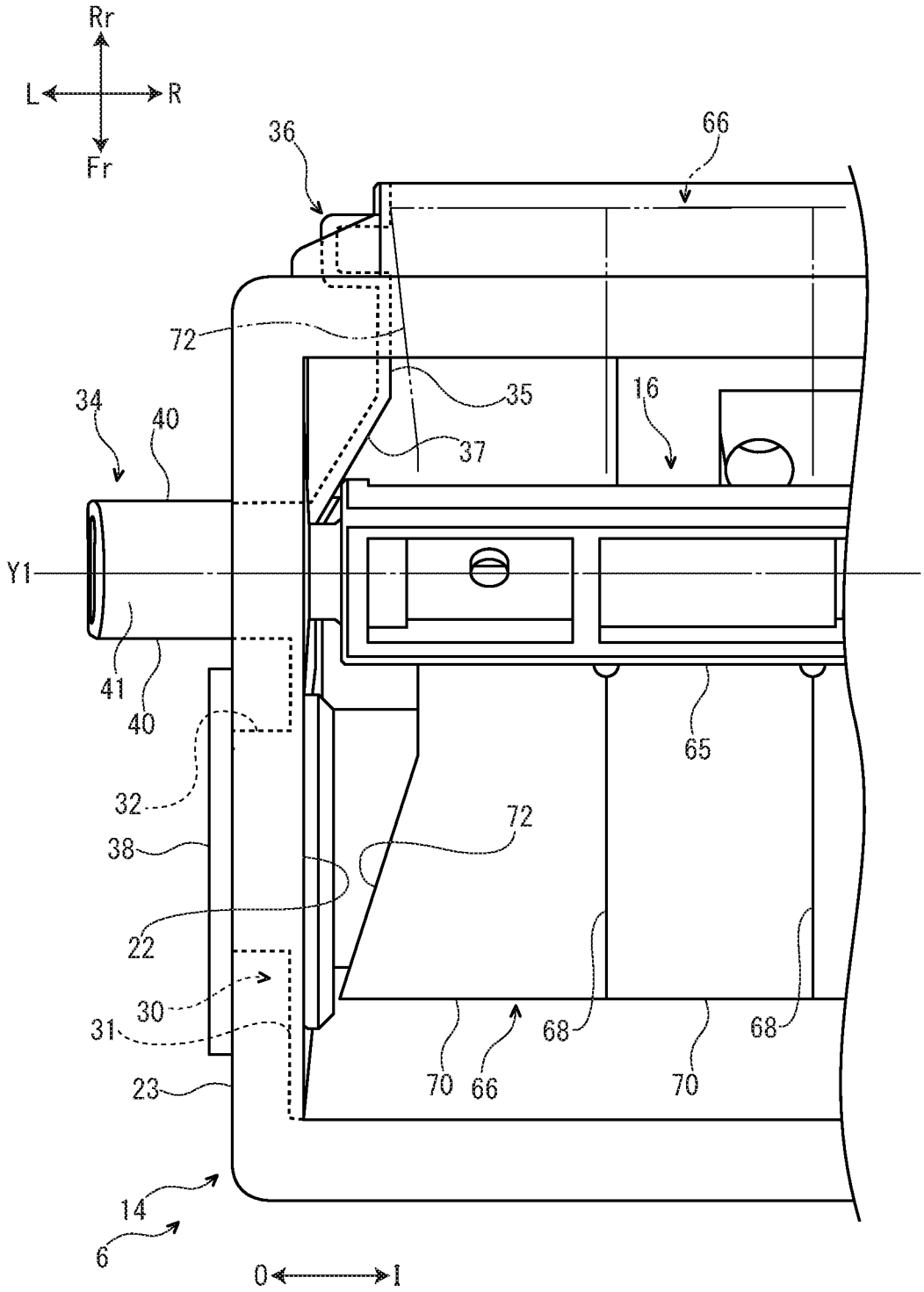
FIG. 10 is a plan view showing the left side wall of the case main body and the peripheral portions, in the toner container according to the embodiment of the present disclosure.

The recess part 35 of the left side wall 30 of the case main body 14 is formed in a rear lower corner portion (a corner portion on a side separating from the lid member 21) of the left side wall 30. The recess part 35 is formed so as to surround the second bearing part 36. With reference to FIG. 10 and other figures, the recess part 35 is shaped into a flat plate. An inner face of the recess part 35 protrudes rightward (inward in the left and right direction) with respect to the inner face of the base part 31 by a depth at which the recess part 35 is recessed rightward (inward in the left and right direction) with respect to the base part 31.

Figure 11:
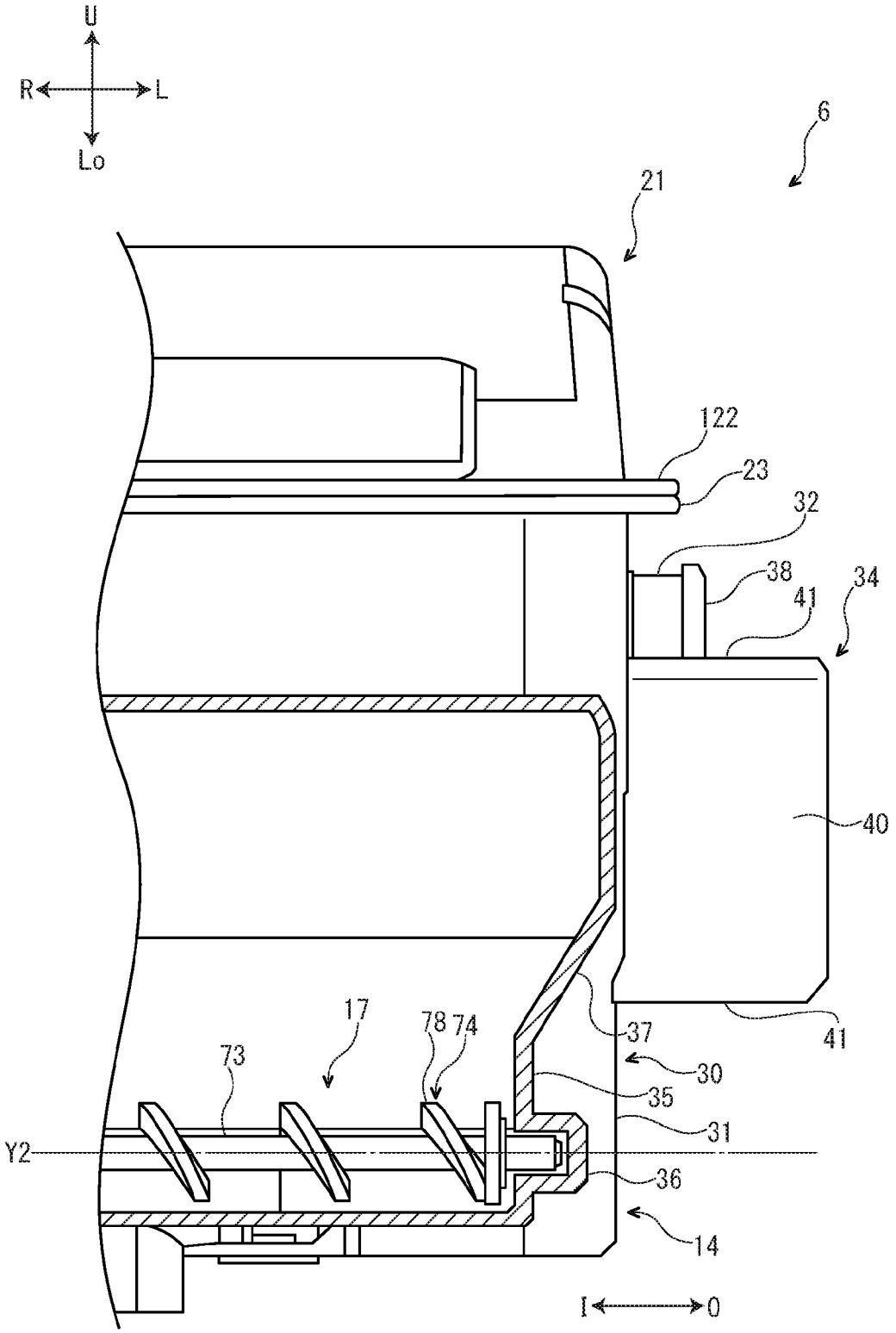
FIG. 11 is a sectional view showing the left side wall of the case main body and the peripheral portions, in the toner container according to the embodiment of the present disclosure.

With reference to FIG. 11 and other figures, the second bearing part 36 of the left side wall 30 of the case main body 14 is integrally formed with the recess part 35. The second bearing part 36 is shaped into a bottomed cylinder whose left end portion (an outer end portion in the left and right direction) is closed. The left end portion (the outer end portion in the left and right direction) of the second bearing part 36 is positioned closer to the right side (the inner side in the left and right direction) than the outer face of the base part 31.

The connecting part 37 of the left side wall 30 of the case main body 14 inclines so that the connecting part 37 is separated from the second bearing part 36 toward the left side (the outside in the left and right direction) An inner face of the connecting part 37 inclines to a horizontal direction.

Figure 12:
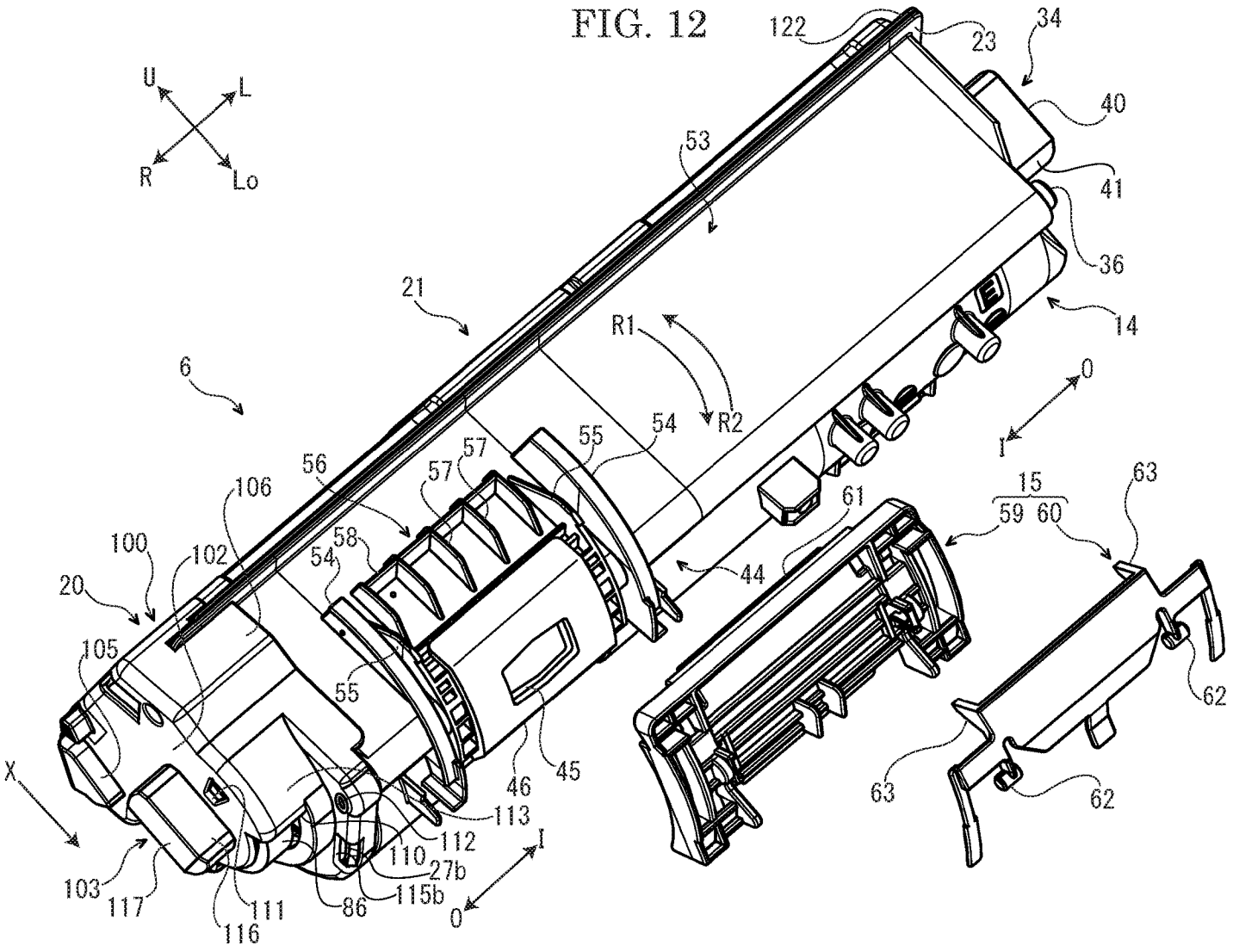
FIG. 12 is an exploded perspective view showing the toner container according to the embodiment of the present disclosure.

With reference to FIG. 12 and other figures, a bottom wall 44 of the case main body 14 has a toner discharge port 45. On an outer face of the bottom wall 44 of the case main body 14, a seal member 46 is fixed around the toner discharge port 45.

On the outer faces of the bottom wall 44 and a rear side wall 53 (a side wall in a width direction) of the case main body 14, a pair of supporting ribs 54 protrude at a predetermined interval in the left and right direction. On the outer faces of the bottom wall 44 and the rear side wall 53 of the case main body 14, a pair of engagement ribs 55 protrudes at a predetermined interval in the left and right direction between the pair of supporting ribs 54. On the outer face of the rear side wall 53 of the case main body 14, a facing rib 56 protrudes between the pair of supporting ribs 54 and between the pair of engagement ribs 55. The facing rib 56 is arranged on an upstream side in the first rotation direction R1 of the toner discharge port 45.

The facing rib 56 of the rear side wall 53 of the case main body 14 has a plurality of (for example, five) first plate parts 57 and a second plate part 58 connecting upper portions (portions on a side separating from the toner discharge port 45) of the plurality of first plate parts 57. Each of the first plate parts 57 is formed along the first and second rotation directions R1, R2. A lower end portion (a downstream side end portion in the first rotation direction R1) of each of the first plate parts 57 is tapered toward the lower side (a downstream side in the first rotation direction R1). The second plate part 58 is formed along the left and right direction.

Figure 13:
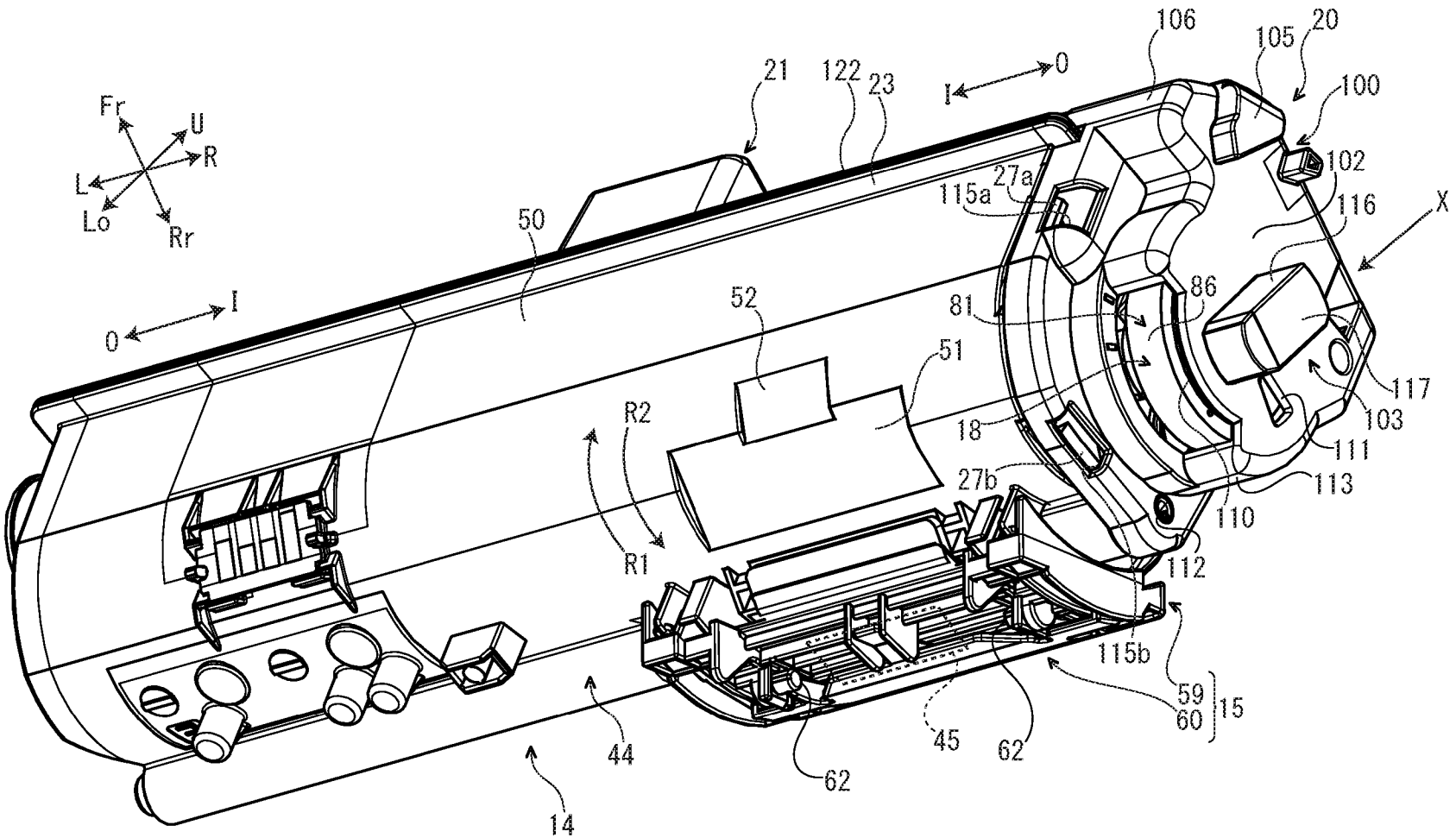
FIG. 13 is a front lower side perspective view showing the toner container according to the embodiment of the present disclosure.

With reference to FIG. 13 and other figures, a front side wall 50 of the case main body 14 is shaped into a flat plate having no rib or the like. On the outer face of the bottom wall 44 of the case main body 14, a first depressed part 51 and a second depressed part 52 are formed. The first and second depressed parts 51, 52 are arranged on the downstream side in the first rotation direction R1 of the toner discharge port 45. Each of the first and second depressed parts 51, 52 is formed into a flat plane. The second depressed part 52 is formed continuously to the first depressed part 51 on the downstream side in the first rotation direction R1 of the first depressed part 51. A lower end portion (an upstream side end portion in the first rotation direction R1) of the second depressed part 52 enters a front end portion (a downstream side end portion in the first rotation direction R1) of the first depressed part 51. The second depressed part 52 has a width in the left and right direction narrower than a width in the left and right direction of the first depressed part 51. The second depressed part 52 inclines with respect to the first depressed part 51 and is not formed on a same plane as the first depressed part 51.

Next, the discharge shutter 15 of the toner container 6 will be described.

The discharge shutter 15 is provided along the outer face of the case main body 14. The discharge shutter 15 is configured to open and close the toner discharge port 45 from the lower side (the outer face side of the case main body 14).

With reference to FIG. 12 and other figures, the discharge shutter 15 has a shutter main body 59 and a stopper 60 attached on an outer face of the shutter main body 59.

Figure 14:
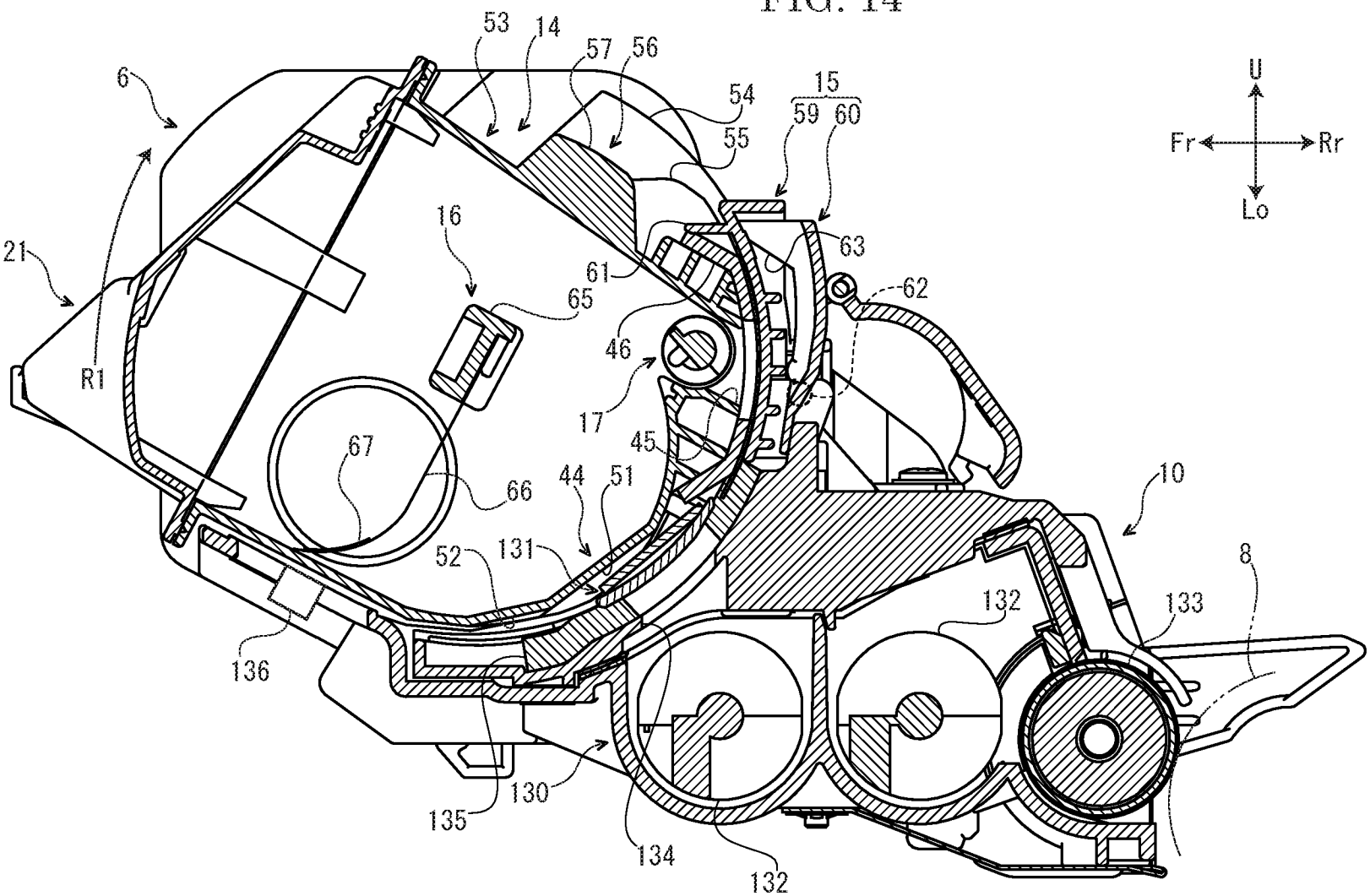
FIG. 14 is a sectional view showing a state where the case main body is positioned in a closing position, in the printer according to the embodiment of the present disclosure.
Figure 15:
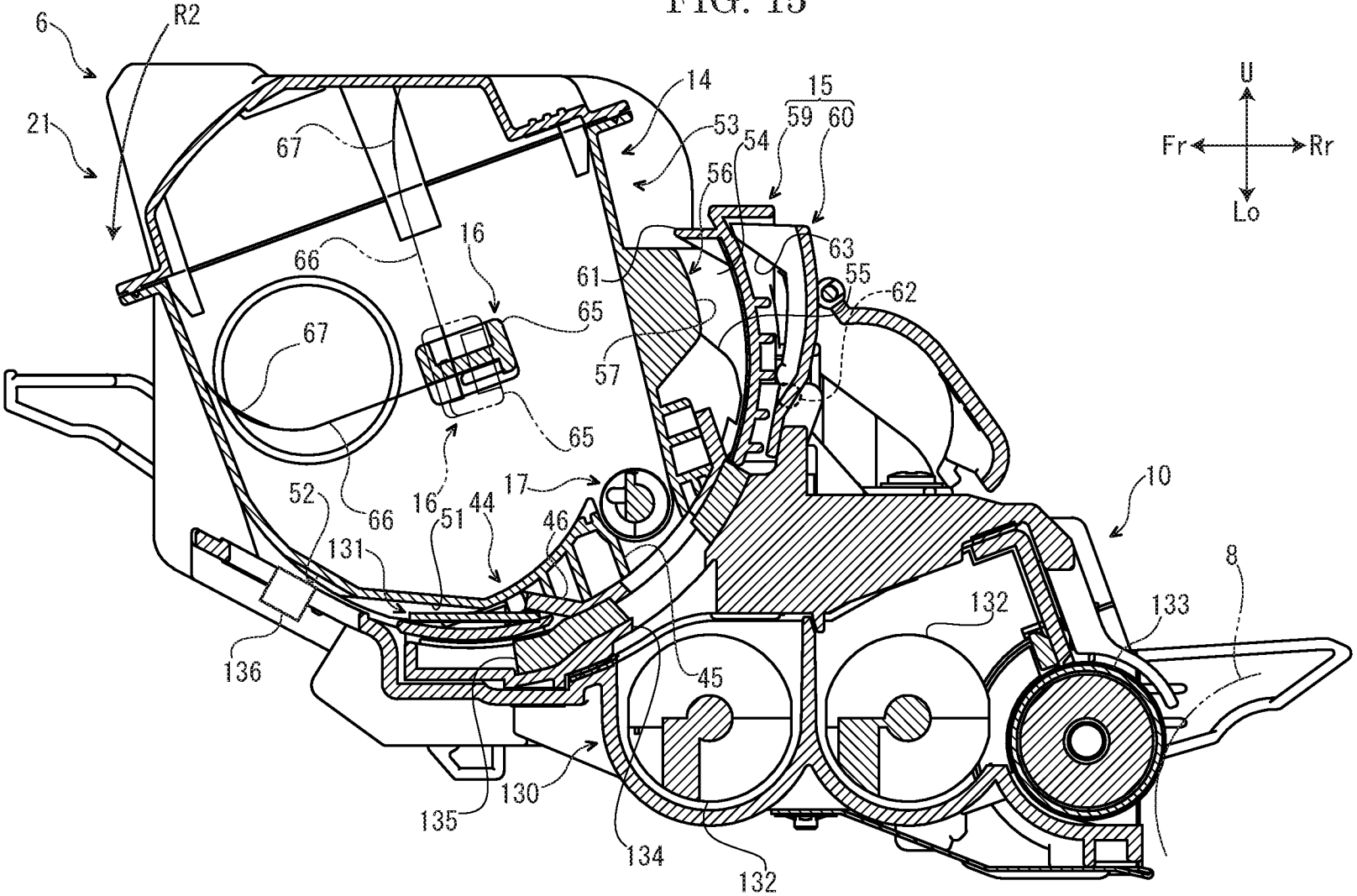
FIG. 15 is a sectional view showing a state where the case main body is positioned in an opening position, in the printer according to the embodiment of the present disclosure.

The shutter main body 59 of the discharge shutter 15 is formed into a curved shape in an arc along the outer face of the case main body 14. The shutter main body 59 is rotatably supported by the pair of supporting ribs 54 which protrude from the outer faces of the bottom wall 44 and the rear side wall 53 of the case main body 14. In this manner, the case main body 14 is configured to rotate with respect to the discharge shutter 15 between a closing position (refer to FIG. 14) where the shutter main body 59 is made to close the toner discharge port 45 and an opening position (refer to FIG. 15) where the shutter main body 59 is made to open the toner discharge port 45. The first rotation direction R1 described above is a rotation direction of the case main body 14 from the closing position to the opening position and the second rotation direction R2 described above is a rotation direction of the case main body 14 from the opening position to the closing position. With reference to FIG. 14, FIG. 15 and other figures, from an upper portion (the upstream side portion in the first rotation direction R1) of an inner face of the shutter main body 59, an inner rib 61 protrudes.

With reference to FIG. 12 and other figures, the stopper 60 of the discharge shutter 15 has a pair of left and right fulcrum parts 62. The stopper 60 is configured to rotate with respect to the shutter main body 59 around the pair of left and right fulcrum parts 62. The stopper 60 has a pair of left and right engagement parts 63 on the upstream side in the first rotation direction R1 of the pair of left and right fulcrum parts 62. In a state where the toner container 6 is not attached to the development device 10, the pair of left and right engagement parts 63 are engaged with the pair of engagement ribs 55 of the case main body 14 to prevent the rotation of the case main body 14 from the closing position to the opening position.

Next, the agitating paddle 16 of the toner container 6 will be described.

With reference to FIG. 4 and other figures, the agitating paddle 16 is configured to rotate around a first rotation axis Y1 extending along the left and right direction. In the present embodiment, the left and right direction is a direction of the rotation axis of the agitating paddle 16.

The agitating paddle 16 has an agitating shaft 65 extending along the left and right direction, an agitating blade 66 attached to the agitating shaft 65 and a detected piece 67 attached to a right side portion of the agitating blade 66.

With reference to FIG. 8 and other figures, a right end portion (one end portion in the left and right direction) of the agitating shaft 65 of the agitating paddle 16 is rotatably supported by the first rotatably supporting part 25 formed on the right side wall 24 of the case main body 14. A left end portion (the other end portion in the left and right direction) of the agitating shaft 65 is rotatably supported by the first bearing part 33 formed on the left side wall 30 of the case main body 14.

With reference to FIG. 4 and other figures, the agitating blade 66 of the agitating paddle 16 is shaped into a sheet elongated in the left and right direction. The agitating blade 66 is made of a resin film, such as a Polyethylen Terephtalate (PET) film, having flexibility. The agitating blade 66 is divided into a plurality of sheet pieces 70 by slits 68 extending along a direction perpendicular to the left and right direction. The second sheet piece 70 from the right side of the agitating blade 66 has a fixing piece 71 protruding toward a side separating from the agitating shaft 65. With reference to FIG. 15 and other figures, the agitating blade 66 is configured to come in contact with and separate from the inner face of the case main body 14 as the agitating paddle 16 rotates.

With reference to FIG. 10 and other figures, a left end portion (an outer end portion in the left and right direction) of the agitating blade 66 of the agitating paddle 16 is positioned closer to a left side (an outer side in the left and right direction) than the inner face of the recess part 35 formed on the left side wall 30 of the case main body 14. On a left end part of the agitating blade 66, an inclined part 72 is formed. The inclined part 72 inclines so that the inclined part 72 is separated from the agitating shaft 65 toward the left side (outside in the left and right direction).

With reference to FIG. 4 and other figures, the detected piece 67 of the agitating paddle 16 is fixed to the fixing piece 71 of the agitating blade 66.

Next, the conveying screw 17 of the toner container 6 will be described.

With reference to FIG. 4 and other figures, the conveying screw 17 is configured to rotate around a second rotation axis Y2 extending along the left and right direction. In the present embodiment, the left and right direction is a direction of the rotation axis of the conveying screw 17. The second rotation axis Y2 is parallel to the first rotation axis Y1 and arranged on an axis line different from an axis line of the first rotation axis Y1. Hereinafter, with regard to a description of each part of the conveying screw 17, "an outer side in a radial direction" is a side separating from the second rotation axis Y2 and "an inner side in the radial direction" is a side close to the second rotation axis Y2.

Figure 16:
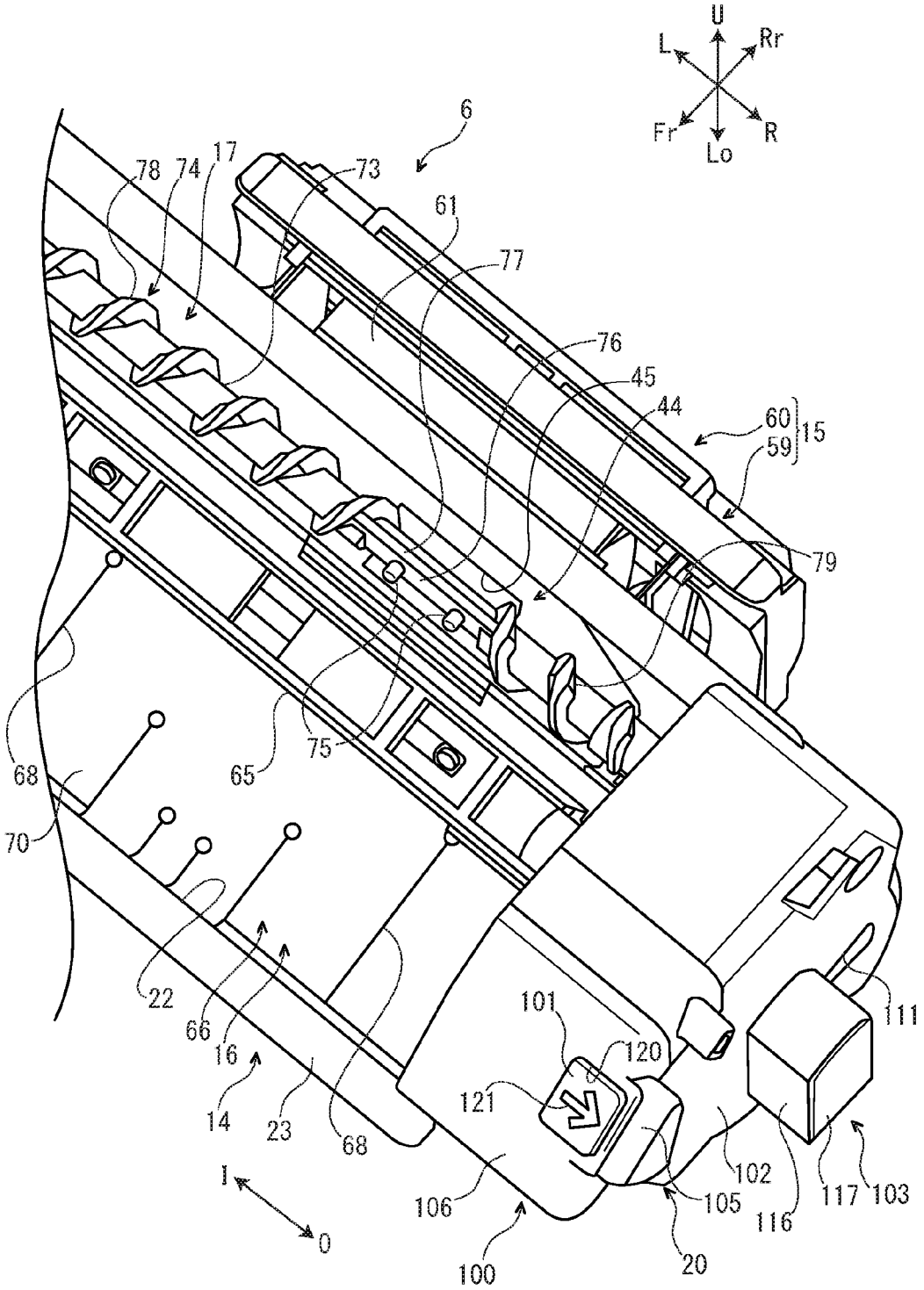
FIG. 16 is a perspective view showing a cover and its peripheral portions, in the toner container according to the embodiment of the present disclosure.

With reference to FIG. 16 and other figures, the conveying screw 17 has a conveying shaft 73 extending along the left and right direction, a conveying fin 74 protruding spirally around an outer circumferential face of the conveying shaft 73 and a pair of projection parts 75 protruding toward the outer side in the radial direction from a right side portion of the conveying shaft 73.

With reference to FIG. 6 and other figures, a right end portion (one end portion in the left and right direction) of the conveying shaft 73 of the conveying screw 17 extends toward the second rotatably supporting part 26 of the right side wall 24 of the case main body 14. With reference to FIG. 11 and other figures, a left end portion (the other end portion in the left and right direction) of the conveying shaft 73 is rotatably supported by the second bearing part 36 of the left side wall 30 of the case main body 14.

Figure 17A:
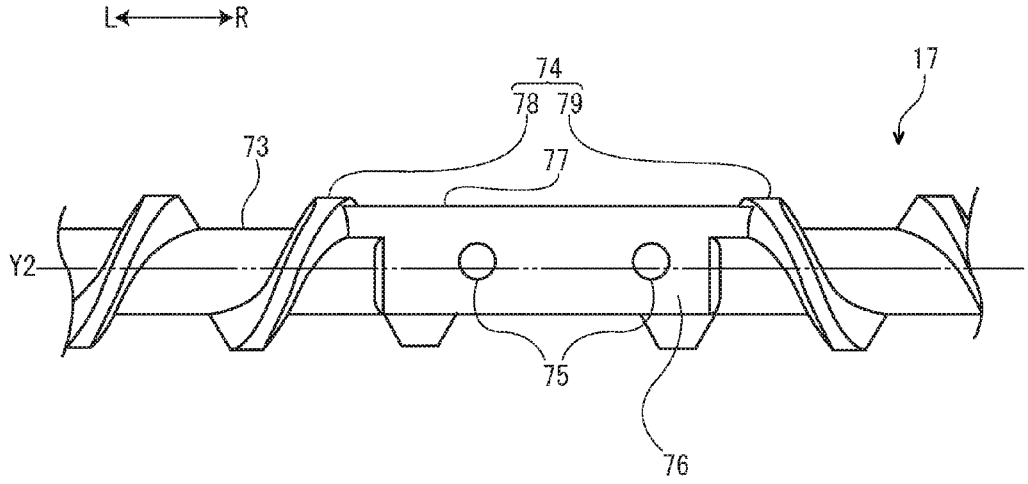
FIG. 17A is a front view showing a pair of projection parts and its peripheral portions when the conveying screw is in a predetermined rotation position, in the toner container according to the embodiment of the present disclosure.
Figure 17B:
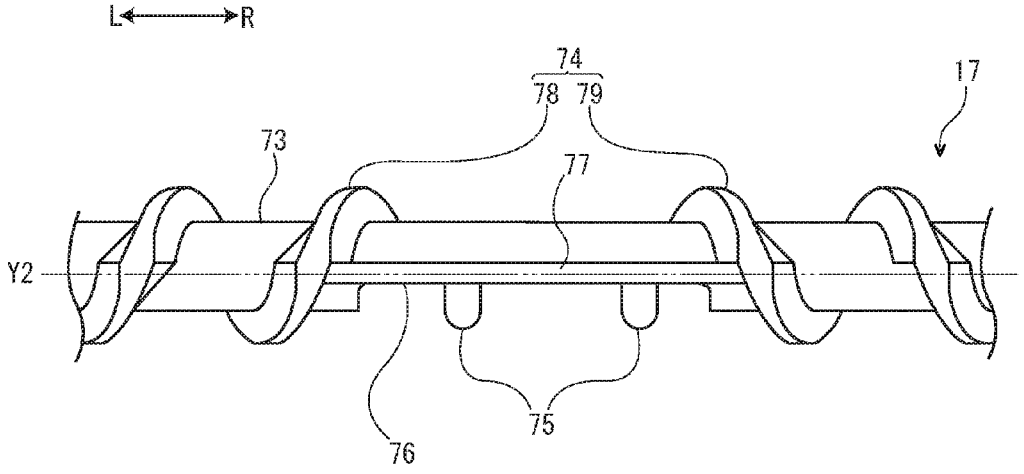
FIG. 17B is a plan view showing the pair of projection parts and the peripheral portions when the conveying screw is in the predetermined rotation position, in the toner container according to the embodiment of the present disclosure.

With reference to FIG. 16, FIG. 17A, FIG. 17B and other figures, on the right side portion of the conveying shaft 73 of the conveying screw 17, a seat part 76 is formed so as to overlap with the toner discharge port 45 in the left and right direction. The seat part 76 is recessed toward the inner side in the radial direction from the outer circumferential face of the conveying shaft 73 and is shaped into a flat plane. On the right side portion of the conveying shaft 73, a protruding piece 77 is formed so as to overlap with the toner discharge port 45 in the left and right direction. The protruding piece 77 protrudes from one side of the seat part 76 in a direction perpendicular (crossing) to the protruding direction of the pair of projection parts 75.

The conveying fin 74 of the conveying screw 17 is formed around the conveying shaft 73 so as to keep away from the seat part 76. In other words, the conveying fin 74 is not formed on the seat part 76. The conveying fin 74 has one side spiral part 78 formed on the left side (one side in the left and right direction) of the pair of projection parts 75 and the other side spiral part 79 formed on the right side (the other side in the left and right direction) of the pair of projection parts 75. The one side spiral part 78 is not connected to the other side spiral part 79. The spiral directions of the one side spiral part 78 and the other side spiral part 79 are opposite to each other.

The pair of projection parts 75 of the conveying screw 17 is arranged so as to overlap with the toner discharge port 45 in the left and right direction and positioned just above the toner discharge port 45. The pair of projection parts 75 are formed at a predetermined interval in the left and right direction. Each projection part 75 is shaped into a straight column. Each projection part 75 protrudes toward the outer side in the radial direction from the seat part 76 of the conveying shaft 73. A protruded end portion of each projection part 75 is positioned closer to the outer side in the radial direction than the outer circumferential face of the conveying shaft 73 and closer to the inner side in the radial direction than the protruded end portions of the one side and the other side spiral parts 78, 79 of the conveying fin 74.

Next, the rotation transmitting mechanism 18 of the toner container 6 will be described.

With reference to FIG. 6 and other figures, the rotation transmitting mechanism 18 has a first transmitting member 81, a second transmitting member 82 provided at the rear lower side of the first transmitting member 81 and a connecting member 83 provided between the first transmitting member 81 and the second transmitting member 82.

The first transmitting member 81 of the rotation transmitting mechanism 18 is configured to rotate around the first rotation axis Y1 and along the outer face of the right side wall 24 of the case main body 14. Hereinafter, with regard to a description of each part of the first transmitting member 81, "an outer side in a radial direction" is a side separating from the first rotation axis Y1 and "an inner side in the radial direction" is a side close to the first rotation axis Y1.

With reference to FIG. 8 and other figures, the first transmitting member 81 has a main body part 84 and a joint part 85 protruding leftward (inward in the left and right direction) from the main body part 84.

On an outer circumferential face of the main body part 84 of the first transmitting member 81, an outer gear 86 and an inner gear 87 are formed. The outer gear 86 is arranged on the right side (on the outer side in the left and right direction) of the inner gear 87 and has a diameter larger than that of the inner gear 87.

Figure 18A:
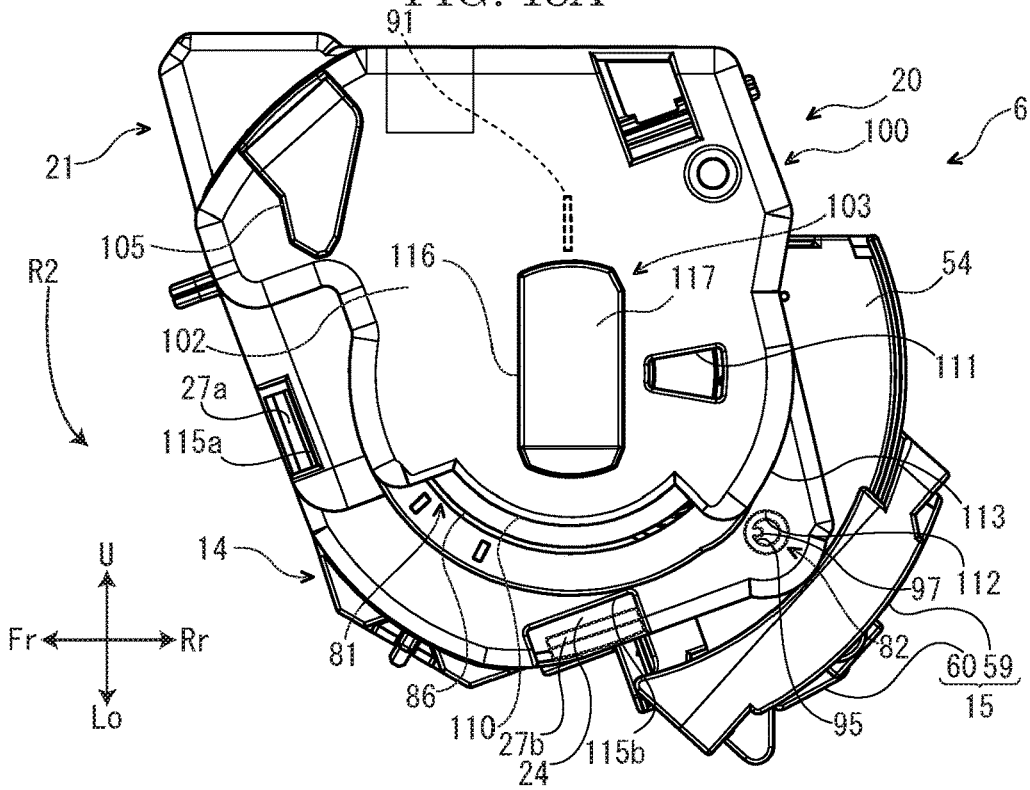
FIG. 18A is a side view showing a state where a first movable part is covered with the cover, in the toner container according to the embodiment of the present disclosure.
Figure 18B:
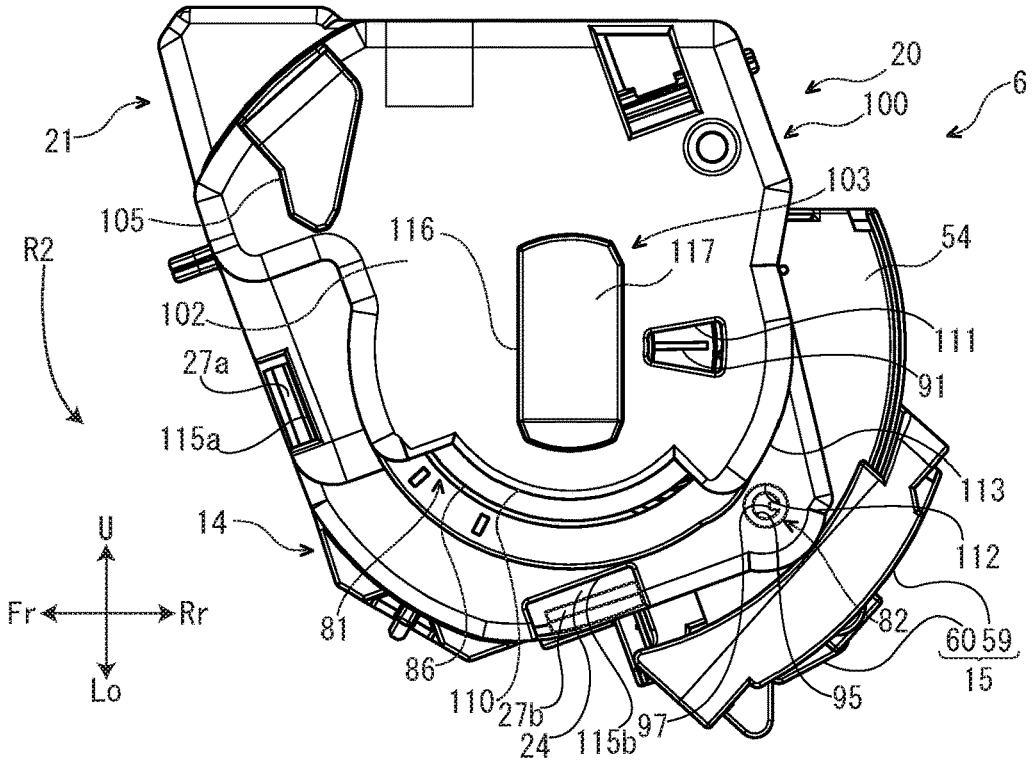
FIG. 18B is a side view showing a state where the first movable part is exposed through a first hole part, in the toner container according to the embodiment of the present disclosure.

With reference to FIG. 6 and other figures, on the outer face of the main body part 84 of the first transmitting member 81, a pair of cylindrical parts 88, 89 (an inner cylindrical part 88 and an outer cylindrical part 89) protrude. The pair of cylindrical parts 88, 89 are formed into concentric cylindrical shapes around the first rotation axis Y1. The outer cylindrical part 89 is arranged on the outer side in the radial direction of the inner cylindrical part 88. On the outer face of the main body part 84, a first movable part 91 protrudes. The first movable part 91 is formed along a radial direction around the first rotation axis Y1. The first movable part 91 is stored in an annular groove 92 formed between the outer gear 86 and the outer cylindrical part 89. With reference to FIG. 18A, FIG. 18B and other figures, the first movable part 91 is configured to move as the first transmitting member 81 rotates.

With reference to FIG. 8 and other figures, the joint part 85 of the first transmitting member 81 penetrates the first rotatably supporting part 25 formed on the right side wall 24 of the case main body 14 and is fixed to the right end portion of the agitating shaft 65 of the agitating paddle 16. In this manner, the first transmitting member 81 is configured to rotate integrally with the agitating paddle 16.

With reference to FIG. 6 and other figures, the second transmitting member 82 of the rotation transmitting mechanism 18 is configured to rotate around the second rotation axis Y2 and along the outer face of the right side wall 24 of the case main body 14.

The second transmitting member 82 has a transmitting piece 93, a joint piece 94 protruding leftward (inward in the left and right direction) from the transmitting piece 93 and a supported piece 95 protruding rightward (outward in the left and right direction) from the transmitting piece 93.

On an outer circumferential face of the transmitting piece 93 of the second transmitting member 82, a transmitting gear 96 is formed. The joint piece 94 of the second transmitting member 82 penetrates the second rotatably supporting part 26 formed on the right side wall 24 of the case main body 14 and is fixed to the right end portion of the conveying shaft 73 of the conveying screw 17. In this manner, the second transmitting member 82 is configured to rotate integrally with the conveying screw 17.

On an inner circumferential face of the supported piece 95 of the second transmitting member 82, a second movable part 97 protrudes. The second movable part 97 is formed along a radial direction around the second rotation axis Y2. With reference to FIG. 18A, FIG. 18B and other figures, the second movable part 97 is configured to move as the second transmitting member 82 rotates.

With reference to FIG. 6 and other figures, on an outer circumferential face of the connecting member 83 of the rotation transmitting mechanism 18, a small diameter gear 98 and a large diameter gear 99 are formed. The small diameter gear 98 is arranged on the right side (the outer side in the left and right direction) of the large diameter gear 99 and has a diameter smaller than that of the large diameter gear 99. The small diameter gear 98 is engaged with the inner gear 87 of the first transmitting member 81 and the large diameter gear 99 is engaged with the transmitting gear 96 of the second transmitting member 82. In this manner, the first transmitting member 81 is connected to the second transmitting member 82 by the connecting member 83.

Next, the cover 20 of the toner container 6 will be described.

With reference to FIG. 16 and other figures, the cover 20 has a cover main body 100 and an indicating piece 101 fixed to a front upper portion of the cover main body 100.

With reference to FIG. 8 and other figures, the cover main body 100 of the cover 20 covers at least a portion of the right side wall 24 of the case main body 14 and at least a portion of the members 81, 82 and 83 which constitute the rotation transmitting mechanism 18 (FIG. 8 shows only the first transmitting member 81).

With reference to FIG. 8, FIG. 13 and other figures, the cover main body 100 has a main wall part 102, a guide wall part 103 protruding rightward (outward in the left and right direction) from a center portion of the main wall part 102, a support wall part 104 protruding leftward (inward in the left and right direction) from the guide wall part 103, a protruding wall part 105 protruding rightward (outward in the left and right direction) from a front upper corner portion of the main wall part 102 and an extending wall part 106 protruding leftward. (inward in the left and right direction) from an outer circumference of the main wall part 102.

With reference to FIG. 8 and other figures, the main wall part 102 of the cover main body 100 faces the outer face of the right side wall 24 of the case main body 14 and also outer faces of the members 81, 82 and 83 which constitute the rotation transmitting mechanism 18 (FIG. 8 shows only the first transmitting member 81). On a lower part of the main wall part 102, a notch part 110 is formed. Through the notch part 110, a lower portion of the outer gear 86 of the first transmitting member 81 is exposed.

With reference to FIG. 13 and other figures, in a rear portion of the main wall part 102 of the cover main body 100, a rectangular first hole part 111 is formed, and in a rear lower portion of the main wall part 102, a circular second hole part 112 is formed. Due to a stepped portion 113 formed between the first hole part 111 and the second hole part 112, the first hole part 111 is provided closer to the right side (the outside in the left and right direction) than the second hole part 112. With reference to FIG. 18A, FIG. 18B and other figures, the first hole part 111 is arranged so that the first movable part 91 of the first transmitting member 81 is switched between a covered state (an invisible state) and an exposed state (a visible state) depending on a rotation position of the first transmitting member 81. On the other hand, the second hole part 112 is arranged so that the second movable part 97 of the second transmitting member 82 is constantly exposed (is in the visible state) regardless of a rotation position of the second transmitting member 82. Into the second hole part 112, the supported piece 95 of the second transmitting member 82, is inserted. In this manner, an outer circumferential face of the supported piece 95 is supported by the second hole part 112.

On a front end portion of the main wall part 102 of the cover main body 100, an engagement hole 115*a* is formed and, on a lower end portion of the main wall part 102 of the cover main body 100, an engagement hole 115*b* is formed. With the engagement holes 115*a*, 115*b*, the engagement projections 27*a*, 27*b* formed on the right side wall 24 of the case main body 14 are respectively engaged. Downstream side end portions of the engagement projections 27*a*, 27*b* in the second rotation direction R2 (a lower end portion of the engagement projection 27*a*, a rear end portion of the engagement projection 27*b*) come in contact with downstream side end portions of the engagement holes 115*a*, 115*b* in the second rotation direction R2 (a lower end portion of the engagement hole 115*a*, a rear end portion of the engagement hole 115*b*), respectively. Upstream side end portions of the engagement projections 27*a*, 27*b* in the second rotation direction R2 (an upper end portion of the engagement projection 27*a*, a front end portion of the engagement projection 27*b*) do not come in contact with upstream side end portions of the engagement holes 115*a*, 115*b* in the second rotation direction R2 (an upper end portion of the engagement hole 115*a*, a front end portion of the engagement hole 115*b*) respectively and the upstream side end portions of the engagement projections 27*a*, 27*b* face the upstream side end portions of the engagement holes 115*a*, 115*b* with gaps respectively.

With reference to FIG. 13 and other figures, the guide wall part 103 of the cover main body 100 has a shape elongated in the attachment direction X. The guide wall part 103 has a tubular part 116 protruding rightward (outward in the left and right direction) from the main wall part 102 and a plate part 117 which closes a right end (an outer end in the left and right direction) of the tubular part 116.

With reference to FIG. 8 and other figures, the support wall part 104 of the cover main body 100 protrudes leftward (inward in the left and right direction) from an inner face of the plate part 117 of the guide wall part 103. The support wall part 104 is integrally formed with the main wall part 102 and the guide wall part 103. The support wall part 104 is shaped into a cylinder around the first rotation axis Y1. The support wall part 104 is inserted into a space between the pair of cylindrical parts 88, 89 formed on the outer face of the main body part 84 of the first transmitting member 81. By the above configuration, the support wall part 104 supports the first transmitting member 81.

Figure 19:
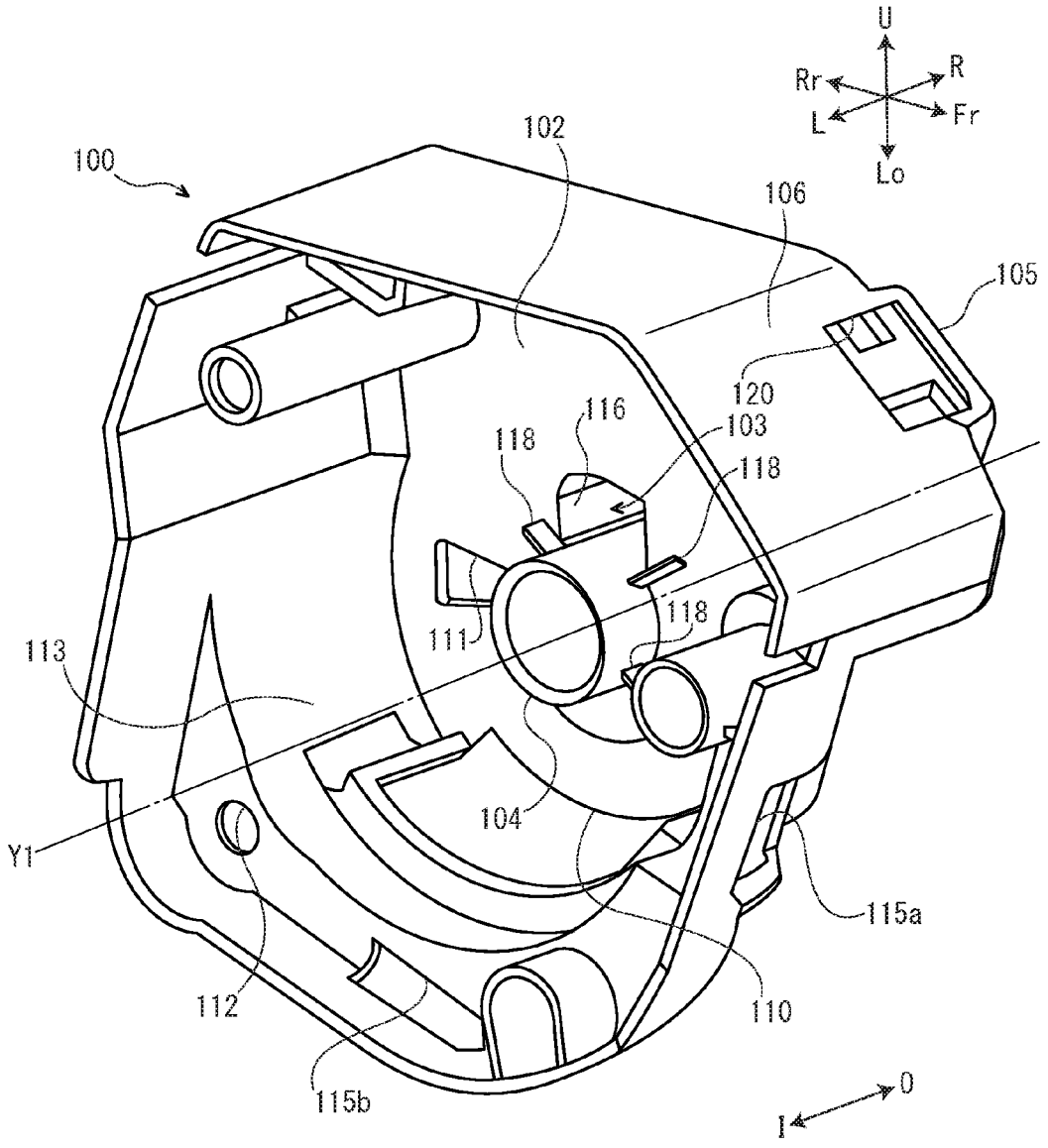
FIG. 19 is a perspective view showing a cover main body of the cover, in the toner container according to the embodiment of the present disclosure.

With reference to FIG. 19 and other figures, an outer circumferential face of the support wall part 104 of the cover main body 100 is connected to the inner face of the main wall part 102 by a plurality of (for example, four) reinforcing wall parts 118. The reinforcing wall parts 118 are formed radially around the first rotation axis Y1. The reinforcing wall parts 118 are formed at equal angles (for example, 90 degree) around the first rotation axis Y1. On a front upper portion of the cover main body 100, a rectangular fixing groove 120 (a fixing part) is formed across the protruding wall part 105 and the extending wall part 106.

With reference to FIG. 16 and other figures, the indicating piece 101 of the cover 20 is fixed to the fixing groove 120 of the cover main body 100. The indicating piece 101 is formed separately from the cover main body 100. The indicating piece 101 is colored with a color different from a color of the cover main body 100. On an outer face of the indicating piece 101, an outward arrow 121 indicating the right side (the outside in the left and right direction) is marked. The outward arrow 121 is formed by a bore penetrating the indicating piece 101 from its outer face to its inner face.

Next, the lid member 21 of the toner container 6 will be described.

With reference to FIG. 8 and other figures, the lid member 21 closes the opening 22 of the case main body 14 from the upper side. Around an outer circumference of the lid member 21, a lid member side flange 122 is formed. The lid member side flange 122 is fixed to the case main body side flange 23 of the case main body 14.

Figure 20:
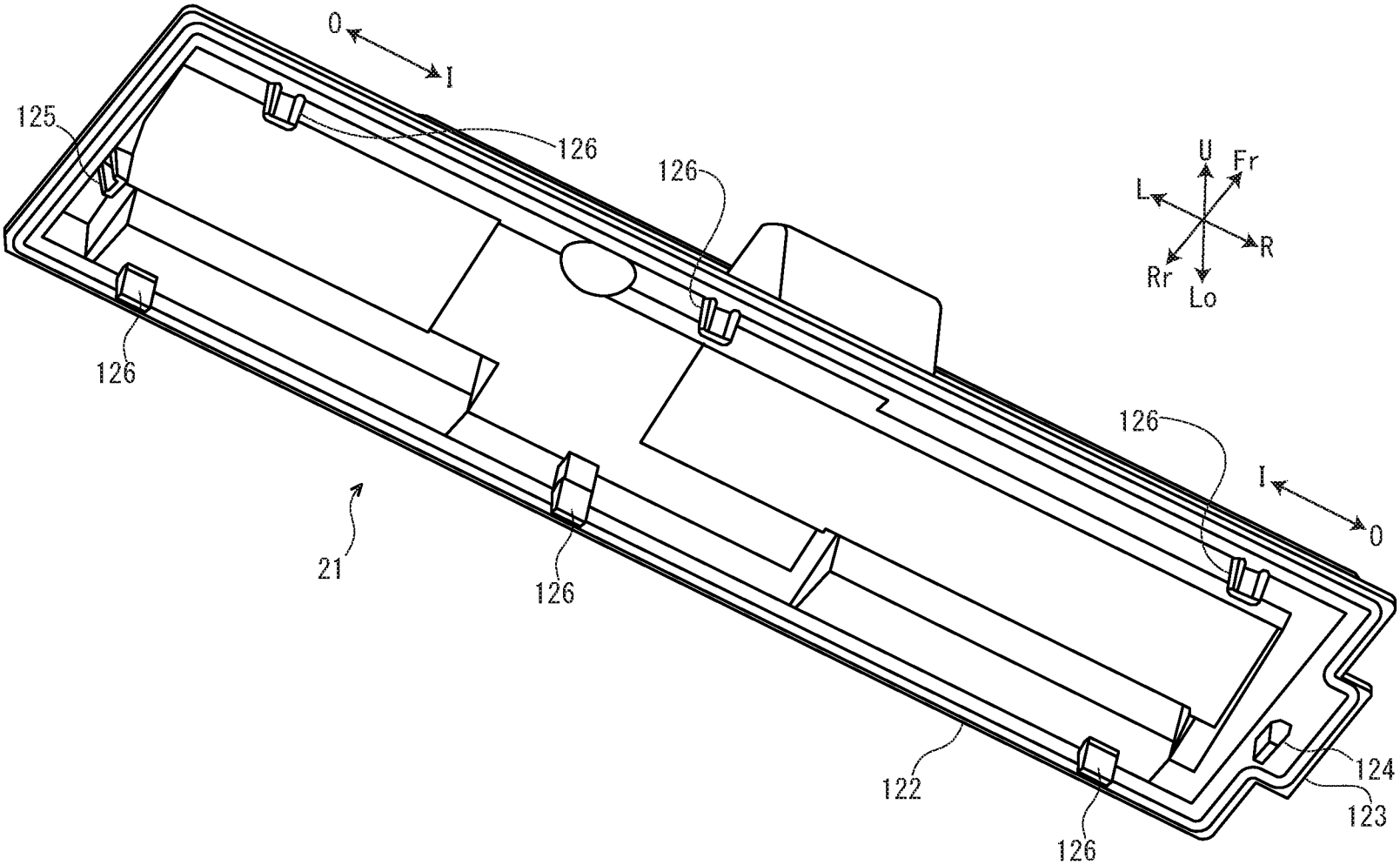
FIG. 20 is a perspective view showing a lid member in the toner container according to the embodiment of the present disclosure.
Figure 21:
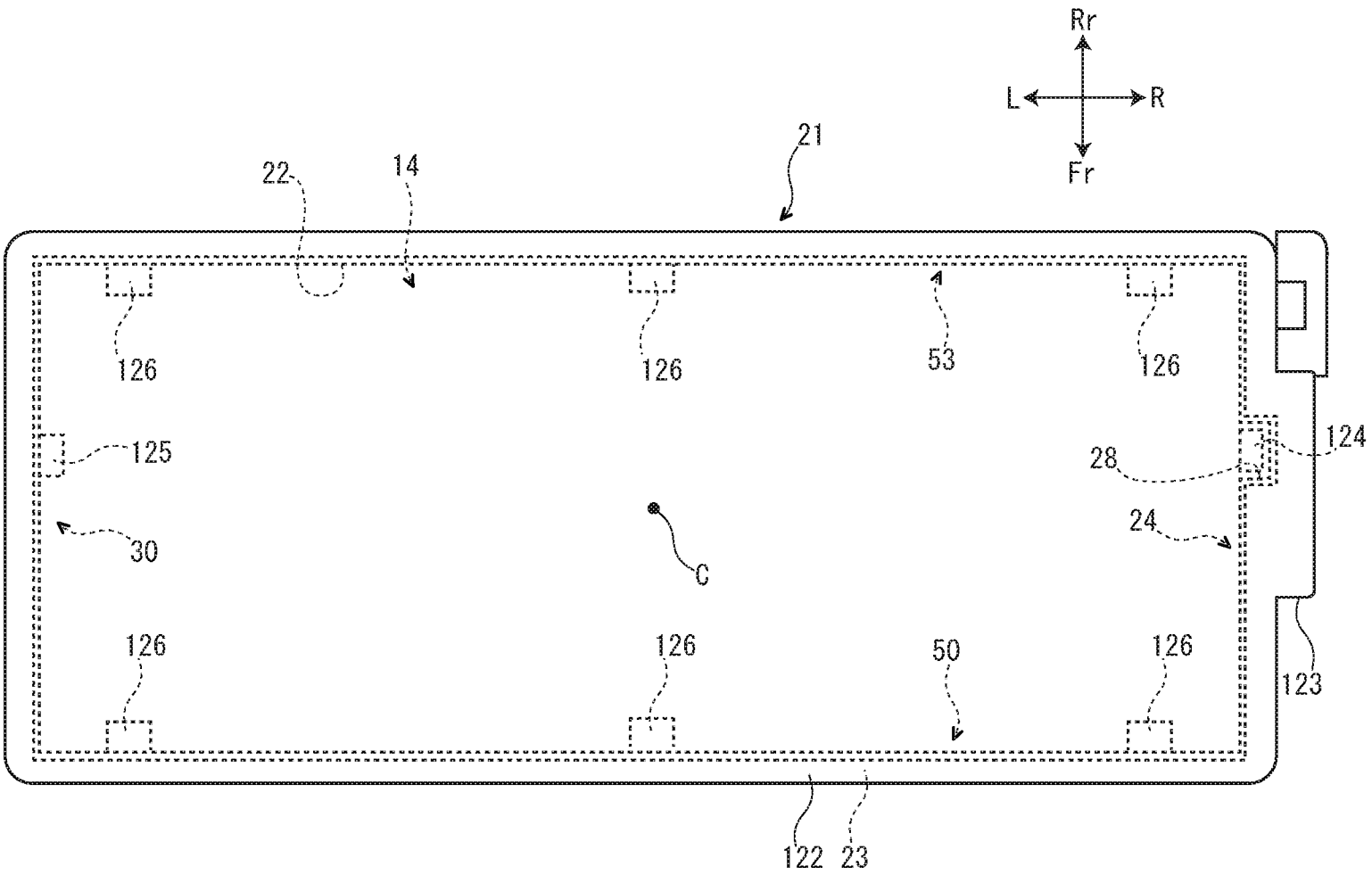
FIG. 21 is a plan view schematically showing a positional relationship between the case main body and the lid member, in the toner container according to the embodiment of the present disclosure.

With reference to FIG. 20, FIG. 21 and other figures, from a right end portion of the lid member side flange 122 of the lid member 21, a protruding plate 123 protrudes rightward. On an inner face of the lid member side flange 122, an insertion projection 124 protrudes at a position corresponding to the protruding plate 123. The insertion projection 124 is inserted into the insertion groove 28 formed on the inner face of the right side wall 24 of the case main body 14.

From an inner face of a left end portion of the lid member 21, a contacting projection 125 protrudes. The contacting projection 125 comes into contact with the inner face of the left side wall 30 of the case main body 14. The contacting projection 125 is arranged asymmetrically to the insertion groove 28 and the insertion projection 124 around a center point C of the opening 22 of the case main body 14.

On inner faces of front and rear side portions of the lid member 21, a plurality of positioning projections 126 protrude. The plurality of positioning projections 126 are formed at intervals in the left and right direction. Each positioning projection 126 comes in contact with the inner faces of the front and rear side walls 50, 53 (both side walls in the width direction) of the case main body 14.

Next, the development device 10 will be described in more detail.

With reference to FIG. 14, FIG. 15 and other figures, the development device 10 has a box-shaped casing 130, a replenishment shutter 131 provided on the upper face side of the casing 130, a pair of front and rear mixers 132 stored in the casing 130 and a development roller 133 (a toner carrier) provided at the rear side of the rear mixer 132.

Figure 22:
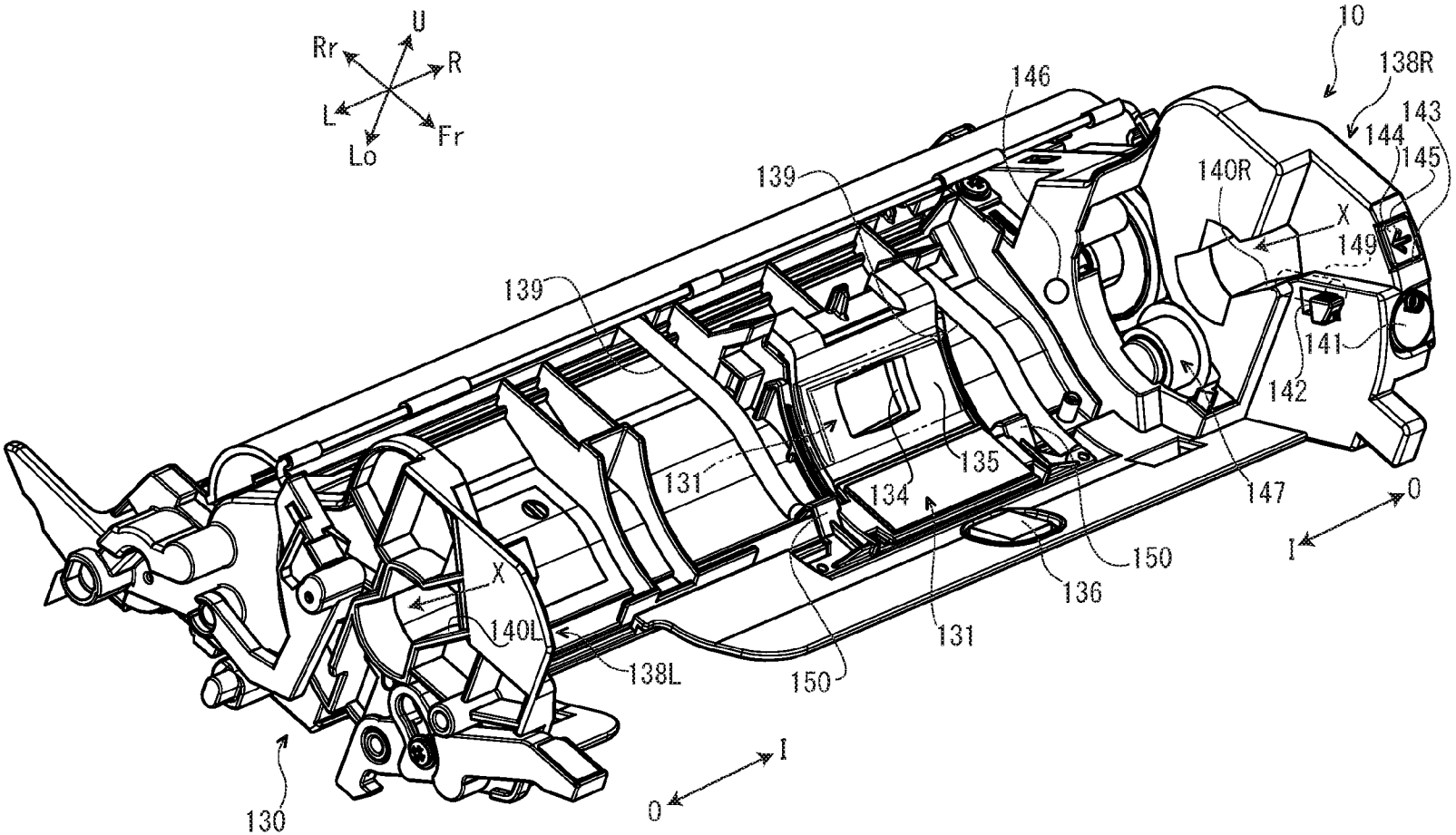
FIG. 22 is a perspective view showing a development device according to the embodiment of the present disclosure.

With reference to FIG. 22 and other figures, on an upper face of the casing 130 of the development device 10, a toner replenishment port 134 is formed. On the upper face of the casing 130, a seal member 135 is fixed around the toner replenishment port 134. On the upper face of the casing 130, a detecting part 136 is formed in front of the toner replenishment port 134.

From the upper face of the casing 130 of the development device 10, a pair of left and right guide frames 138L, 138R protrude. On an inner face of the right guide frame 138R, a guide groove 140R is formed, and on an inner face of the left guide frame 138L, a guide groove 140L is formed. Each of the guide grooves 140R, 140L is formed along the attachment direction X.

To the right guide frame 138R of the casing 130 of the development device 10, a locking member 141 is attached in a movable state in the front and rear direction. The locking member 141 is biased forward by a coil spring 149 (a biasing piece). At a rear portion of the locking member 141, an engagement part 142 is formed.

The right guide frame 138R of the casing 130 of the development device 10 has an attachment groove 143 above the locking member 141. Into the attachment groove 143, an indicating body 144 is attached. The indicating body 144 is formed independently from the casing 130. The indicating body 144 is colored with a color different from a color of the casing 130. On an outer face of the indicating body 144, an inward arrow 145 indicating the left side (the inner side in the left and right direction) is marked.

At a right side portion of the upper face of the casing 130 of the development device 10, a rotation sensor 146 is attached. On a right end portion of the upper face of the casing 130, a driving gear train 147 (a driving part) is provided. The driving gear train 147 is engaged with the outer gear 86 (refer to FIG. 8 and other figures) formed in the main body part 84 of the first transmitting member 81.

The replenishment shutter 131 of the development device 10 is configured to rotate between a closing position (refer to a two-dotted line in FIG. 22) to close the toner replenishment port 134 of the casing 130 and an opening position (refer to a solid line in FIG. 22) to open the toner replenishment port 134 of the casing 130. The replenishment shutter 131 is biased to the closing position by a pair of left and right coil springs 139 (biasing members) provided on the upper face of the casing 130. On left and right end portions of the replenishment shutter 131, contacting pieces 150 are formed.

With reference to FIG. 14, FIG. 15 and other figures, the pair of front and rear mixers 132 of the development device 10 are rotatably supported by the casing 130. The pair of front and rear mixers 132 are configured to agitate the toner supplied into the casing 130 through the toner replenishment port 134 and to convey the toner toward the development roller 133.

The development roller 133 of the development device 10 is rotatably supported by the casing 130. The development roller 133 comes into contact with or is close to the photosensitive drum 8 and is configured to carry the toner agitated by the pair of front and rear mixers 132 and then to supply the agitated toner to the photosensitive drum 8.

Next, in the printer 1 configured as described above, an operation to set the toner container 6 to the development device 10 will be described.

Figure 23:
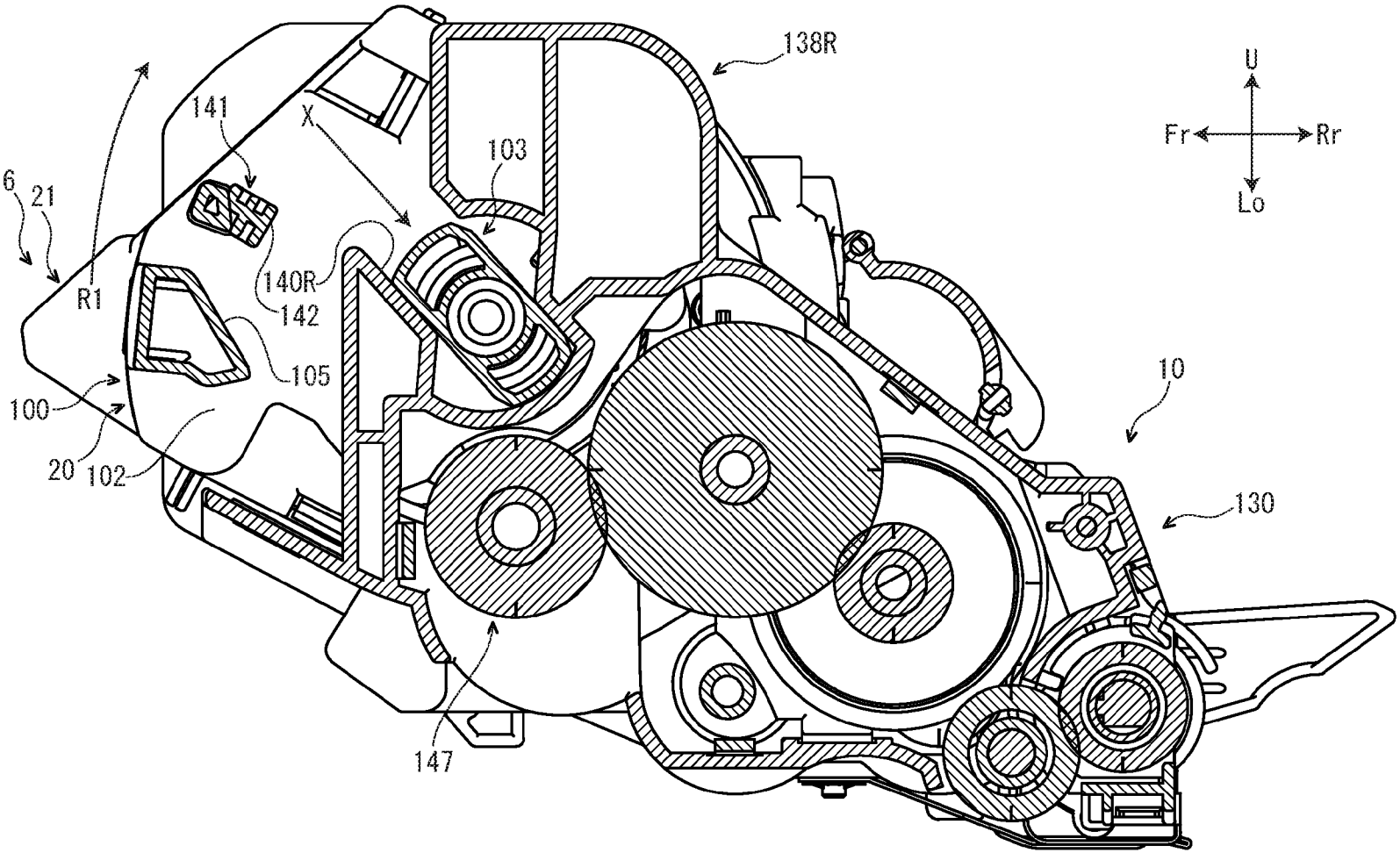
FIG. 23 is a sectional view showing the state where the toner container is positioned in the locking release position, in the printer according to the embodiment of the present disclosure.

First, a worker, for example a user, slides the toner container 6 along the attachment direction X while inserting the guide wall part 103 of the cover 20 into the guide groove 140R of the right guide frame 138R and inserting the guide part 34 of the case main body 14 into the guide groove 140L of the left guide frame 138L. Then, as shown in FIG. 23, the toner container 6 is attached to the development device 10 at the locking release position. In the state, detachment of the toner container 6 from the development device 10 is permitted.

In the state where the toner container 6 is attached to the development device 10 at the locking release position as described above, as shown in FIG. 14 and other figures, the case main body 14 is in the closing position to close the toner discharge port 45 of the case main body 14 with the shutter main body 59 of the discharge shutter 15. In addition, the replenishment shutter 131 is in the closing position to close the toner replenishment port 134 of the casing 130.

Furthermore, when the toner container 6 is attached to the development device 10 at the locking release position as described above, the pair of contacting pieces 150 (refer to FIG. 22 and other figures) of the replenishment shutter 131 come in contact with the pair of supporting ribs 54 (refer to FIG. 12 and other figures) of the case main body 14. Thus, biasing force of the pair of coil springs 139 (refer to FIG. 22 and other figures) acts on the toner container 6 via the replenishment shutter 131 so that the toner container 6 is biased to the locking release position.

Figure 24:
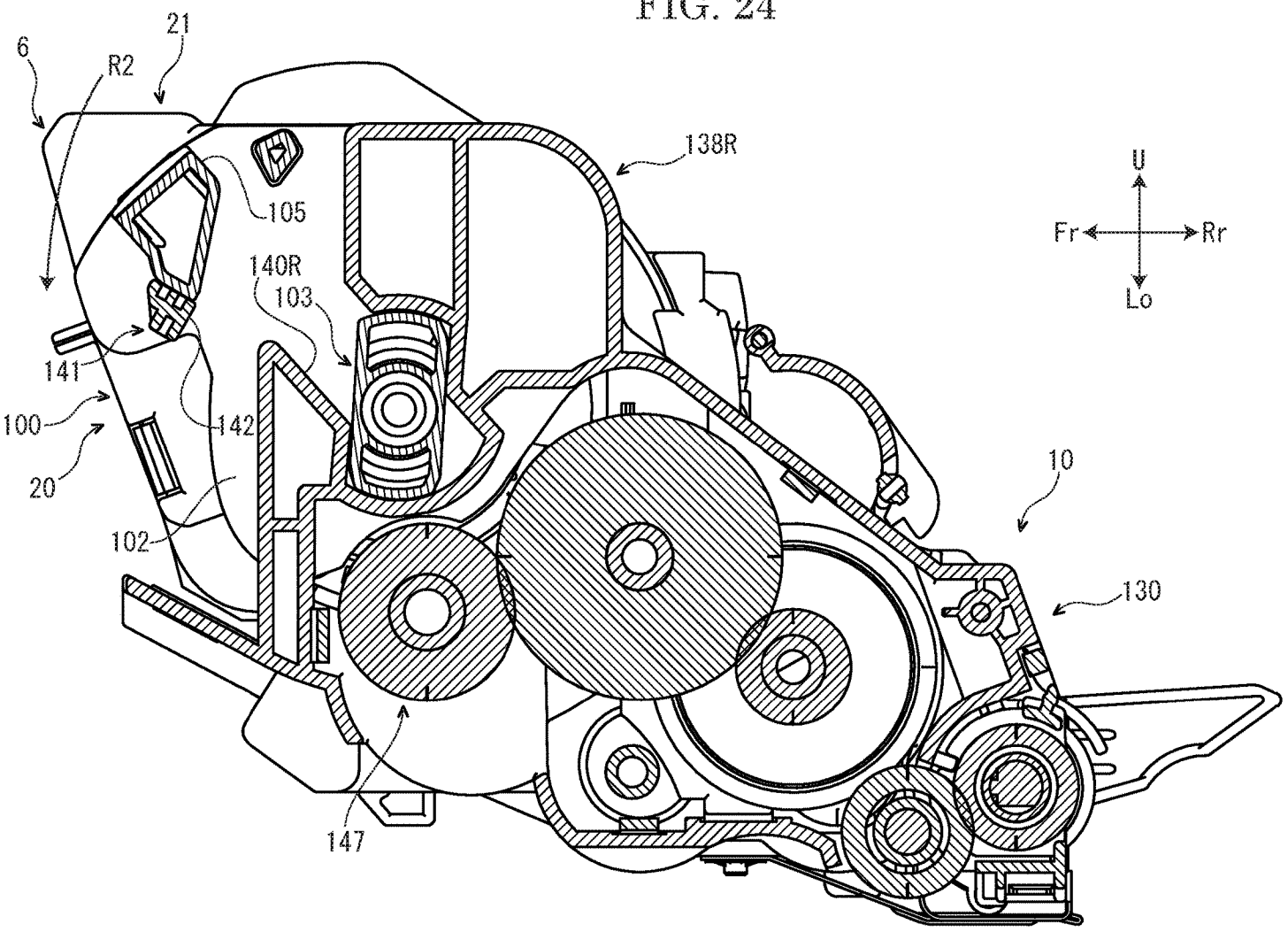
FIG. 24 is a sectional view showing the state where the toner container is positioned in the locking position, in the printer according to the embodiment of the present disclosure.

Next, the worker rotates the toner container 6 from the locking release position to the locking position against the biasing force of the pair of coil springs 139 along the first rotation direction R1 around the guide wall part 103 of the cover 20 and the guide part 34 of the case main body 14. Accordingly, as shown in FIG. 24, the guide wall part 103 of the cover 20 rotates in one direction relative to the guide groove 140R of the right guide frame 138R. Also, the guide part 34 of the case main body 14 rotates in the one direction relative to the guide groove 140L of the left guide frame 138L. Thus, the detachment of the toner container 6 from the development device 10 is restricted. In addition, the protruding wall part 105 of the cover 20 is engaged with the engagement part 142 of the locking member 141. Thus, the toner container 6 is held at the locking position against the biasing force of the pair of coil springs 139.

When the toner container 6 rotates from the locking release position to the locking position as described above, as shown in FIG. 15 and other figures, the case main body 14 rotates from the closing position to the opening position relative to the discharge shutter 15. Thus, the toner discharge port 45 of the case main body 14 is opened by the shutter main body 59 of the discharge shutter 15. In addition, the pair of supporting ribs 54 of the case main body 14 press the pair of contacting pieces 150 of the replenishment shutter 131 to rotate the replenishment shutter 131 from the closing position to the opening position against the biasing force of the pair of the coil springs 139. Thus, the toner replenishment port 134 of the casing 130 is opened by the replenishment shutter 131 to communicate the toner discharge port 45 of the case main body 14 with the toner replenishment port 134 of the casing 130. Accordingly, the operation to set the toner container 6 to the development device 10 is completed.

Next, in the printer 1 configured as described above, an operation to detach the toner container 6 from the development device 10 will be described.

First, the worker presses the locking member 141 (refer to FIG. 22 and other figures) rearward against the biasing force of the coil spring 149 (refer to FIG. 22 and other figures). Thus, the engagement of the protruding wall part 105 of the cover 20 with the engagement part 142 of the locking member 141 is released so that the toner container 6 rotates from the locking position to the locking release position along the second rotation direction R2 by the biasing force of the pair of coil springs 139 around the guide wall part 103 of the cover 20 and the guide part 34 of the case main body 14. Thus, as shown in FIG. 14 and other figures, the case main body 14 rotates from the opening position to the closing position relative to the discharge shutter 15 to close the toner discharge port 45 of the case main body 14 with the shutter main body 59 of the discharge shutter 15. In addition, the replenishment shutter 131 rotates from the opening position to the closing position by the biasing force of the pair of coil springs 139 to close the toner replenishment port 134 of the casing 130.

When the toner container 6 rotates from the locking position to the locking release position as described above, as shown in FIG. 23 and other figures, the guide wall part 103 of the cover 20 rotates in a direction opposite to the above one direction relative to the guide groove 140R of the right guide frame 138R. Also, the guide part 34 of the case main body 14 rotates in the direction opposite to the above one direction relative to the guide groove 140L of the left guide frame 138L. Thus, the detachment of the toner container 6 from the development device 10 is permitted.

Next, the worker slides the toner container 6 along a direction opposite to the attachment direction X while separating the guide wall part 103 of the cover 20 from the guide groove 140R of the right guide frame 138R and separating the guide part 34 of the case main body 14 from the guide groove 140L of the left guide frame 138L. Thus, the toner container 6 is separated from the development device 10. Accordingly, the operation to detach the toner container 6 from the development device 10 is completed.

Next, in the printer 1 configured as described above, an operation (hereinafter, called as "a toner replenishment operation") to replenish the toner from the toner container 6 to the development device 10 will be described.

When the toner replenishment operation is carried out, the driving gear train 147 is rotated by a driving motor (not shown). When the driving gear train 147 is rotated in this way, the rotation is transmitted to the agitating paddle 16 via the first transmitting member 81 so that the agitating paddle 16 rotates integrally with the first transmitting member 81. Thus, the toner contained in the case main body 14 is agitated by the agitating paddle 16. When the agitating paddle 16 rotates in this way, the detected piece 67 of the agitating paddle 16 is detected by the detecting part 136 formed on the upper face of the casing 130.

In addition, when the driving gear train 147 rotates, the rotation is transmitted to the conveying screw 17 via the first transmitting member 81, the connecting member 83 and the second transmitting member 82 so that the conveying screw 17 rotates integrally with the second transmitting member 82. Thus, the toner contained in the case main body 14 is conveyed by the conveying screw 17 toward the toner discharge port 45 and then discharged from the toner discharge port 45. The toner discharged from the toner discharge port 45 is introduced into the casing 130 through the toner replenishment port 134. Thus, the toner replenishment operation is completed.

By the way, during storage and transportation of the above toner container 6, if the agitating paddle 16 is left for a long time at a rotation position where the agitating blade 66 is applied with a large load, the agitating blade 66 may be plastically deformed to deteriorate performance of the agitating blade 66. Accordingly, in the present embodiment, the plastic deformation of the agitating blade 66 is restricted as described below.

FIG. 18A shows a state where the first transmitting member 81 is in a rotation position where the first movable part 91 of the first transmitting member 81 is covered with the cover main body 100 of the cover 20 (a rotation position where the first movable part 91 is invisible). In the state, as shown by a solid line in FIG. 15, the agitating blade 66 is directed to on a side (for example, the front side) other than the upper side and comes in contact with the inner face of the case main body 14. As a result, the load applied to the agitating blade 66 becomes relatively large and the agitating blade 66 is easily plastically deformed.

On the other hand, FIG. 18B shows a state where the first transmitting member 81 is in a rotation position where the first movable part 91 of the first transmitting member 81 is exposed through the first hole part 111 formed in the cover main body 100 of the cover 20 (a rotation position where the first movable part 91 is visible). In the state, as shown by a two-dotted line in FIG. 15, the agitating blade 66 is directed upward, separates from the inner face of the case main body 14 and comes in contact with the inner face of the lid member 21. As a result, the load applied to the agitating blade 66 becomes relatively small and the agitating blade 66 is hardly plastically deformed.

Considering the above description, when the toner container 6 is shipped, the toner container 6 is stored or transported in a state where the first transmitting member 81 is in a rotation position where the first movable part 91 is exposed through the first hole part 111. In this manner, the plastic deformation of the agitating blade 66 before the use of the toner container 6 can be prevented so that the toner contained in the case main body 14 can be agitated sufficiently.

In the present embodiment, the lower portion of the outer gear 86 of the first transmitting member 81 is exposed through the notch part 110 formed in the cover main body 100 of the cover 20. Accordingly, when a shipping operation of the toner container 6 is carried out, a worker can easily rotate the first transmitting member 81 to the rotation position where the first movable part 91 is exposed through the first hole part 111 while turning the exposed lower portion of the outer gear 86 with his finger. This makes it possible to facilitate the shipping operation of the toner container 6.

By the way, in the above toner container 6, if a rotation state of the conveying screw 17 becomes unstable, the toner contained in the case main body 14 may not be discharged smoothly. In the present embodiment, the rotation state of the conveying screw 17 is detected as described below.

When the conveying screw 17 rotates, the second transmitting member 82 fixed to the conveying screw 17 also rotates. Thus, the second movable part 97 of the second transmitting member 82 moves and the movement of the second movable part 97 is detected by the rotation sensor 146 of the development device 10. On the other hand, when the rotation of the conveying screw 17 is stopped, the rotation of the second transmitting member 82 fixed to the conveying screw 17 is also stopped. Accordingly, the movement of the second movable part 97 of the second transmitting member 82 is not detected by the rotation sensor 146 of the development device 10.

In the present embodiment, as described above, by detecting the movement of the second movable part 97, the rotation state of the conveying screw 17 is indirectly detected. In this time, since the second movable part 97 is exposed through the second hole part 112 formed in the cover main body 100 of the cover 20 regardless of the rotation position of the second transmitting member 82, the movement of the second movable part 97 can be accurately detected.

In addition, since the outer circumferential face of the supported piece 95 of the second transmitting member 82 is supported by the second hole part 112, the second transmitting member 82 can be securely prevented from falling down. In addition, by forming the second movable part 97 on the inner circumferential face of the supported piece 95, the second movable part 97 can be surely exposed (be visible).

As described above, the cover main body 100 of the cover 20 has the first hole part 111 arranged so that the first movable part 91 is switched between the exposed state and the covered state depending on the rotation position of the first transmitting member 81 and the second hole part 112 arranged so that the second movable part 97 is exposed regardless of the rotation position of the second transmitting member 82. Accordingly, the single cover 20 can be used for both of detection of the rotation position of the agitating paddle 16 and detection of the rotation state of the conveying screw 17. This enhances convenience of the cover 20.

The first hole part 111 is provided closer to the right side (the outside in the left and right direction) than the second hole part 112. Accordingly, when the toner container 6 is shipped, the worker can easily check whether the first hole part 111 exposes the first movable part 91.

In the present embodiment, as described above, the hole parts 111, 112 which respectively expose the movable parts 91, 97 of the transmitting members 81, 82 are formed in the cover main body 100 of the cover 20. This makes it possible to accurately detect the rotation position of the agitating paddle 16 and the rotation state of the conveying screw 17 by a simple configuration.

By the way, in the present embodiment, the locking member 141 holds the toner container 6 at the locking position against the biasing force of the pair of coil springs 139. Under such a relationship, when the toner container 6 is in the locking position, the case main body 14 is pressed to the downstream side in the second rotation direction R2 and then force for twisting the case main body 14 relative to the cover 20 is generated. If a position relationship between the case main body 14 and the cover 20 may be displaced by the twisting force, a position relationship between the first movable part 91 and the first hole part 111 is also displaced. Then, the rotation position of the agitating paddle 16 may not be accurately detected.

Considering this, in the present embodiment, the downstream side end portions in the second rotation direction R2 of the engagement projections 27*a*, 27*b* (the lower end portion of the engagement projection 27*a*, the rear end portion of the engagement projection 27*b*) come in contact with the downstream side end portions in the second rotation direction R2 of the engagement holes 115*a*, 115*b* (the lower end portion of the engagement hole 115*a*, the rear end portion of the engagement hole 115*b*) respectively. By using such a configuration, if the force for twisting the case main body 14 relative to the cover 20 may be generated, the position relationship between the case main body 14 and the cover 20 may be hardly displaced. Therefore, the displacement in position relationship between the first movable part 91 and the first hole part 111 can be restricted so that the rotation position of the agitating paddle 16 can be accurately detected.

The present embodiment shows a case where two hole parts (the first hole part 111 and the second hole part 112) are formed in the cover 20. On the other hand, in other embodiments, one hole part or three or more hole parts may be formed in the cover 20.

The present embodiment shows a case where the agitating blade 66 comes in contact with the inner face of the lid member 21 in a state where the first transmitting member 81 is in the rotation state where the first movable part 91 is exposed through the first hole part 111. On the other hand, in other embodiments, the agitating blade 66 may separate from the inner face of the lid member 21 in the state where the first transmitting member 81 is in the rotation position where the first movable part 91 is exposed through the first hole part 111.

In addition, the pair of projection parts 75 of the conveying screw 17 is formed so as to overlap with the toner discharge port 45 of the case main body 14 in the left and right direction. Accordingly, it becomes possible to disperse the toner aggregated in a vicinity of the toner discharge port 45 and to discharge the toner through the toner discharge port 45 surely.

Although there is no description in the present embodiment, in other embodiments, a toner agitating film may be fixed to the pair of projection parts 75 of the conveying screw 17. By using such a configuration, it becomes possible to disperse the toner aggregated in the vicinity of the toner discharge port 45 more effectively and to discharge the toner through the toner discharge port 45 more surely.

The present embodiment shows a case where the conveying screw 17 has the pair of projection parts 75. On the other hand, in other embodiments, the conveying screw 17 may have one projection part 75 or three or more projection parts 75.

Next, an operation to assemble the agitating paddle 16 and the lid member 21 to the case main body 14 will be described.

First, as shown in a two-dotted line in FIG. 8, the worker engages the left end portion of the agitating shaft 65 with the first bearing part 33 formed on the left side wall 30 of the case main body 14 and also inserts the right end portion of the agitating shaft 65 into the insertion groove 28 formed on the inner face of the right side wall 24 of the case main body 14. In this state, the agitating shaft 65 is held in a straight form.

Next, the worker presses the right end portion of the agitating shaft 65 from the upper side. The pressing slides the right end portion of the agitating shaft 65 along the insertion groove 28 from the upper side (the side of the opening 22) toward the lower side (the side of the first rotatably supporting part 25) and also elastically deforms the agitating shaft 65 so as to be bent downward. When the worker further presses the right end portion of the agitating shaft 65 from the upper side, the right end portion of the agitating shaft 65 passes by the insertion groove 28 and is engaged with the first rotatably supporting part 25 and the agitating shaft 65 is elastically returned to the original straight form. Accordingly, the operation to assemble the agitating paddle 16 to the case main body 14 is completed.

Next, the worker attaches the lid member 21 to the case main body 14 from the upper side while inserting the insertion projection 124 of the lid member 21 into the insertion groove 28. Thus, the operation to assemble the lid member 21 to the case main body 14 is completed.

In the present embodiment, on the inner face of the right side wall 24 of the case main body 14, the insertion groove 28 extending from the upper side (the side of the opening 22) to the lower side (the side of the first rotatably supporting part 25) is formed. Accordingly, it become possible to engage the right end portion of the agitating shaft 65 with the first rotatably supporting part 25 easily so that the agitating paddle 16 can be easily assembled to the case main body 14.

In addition, by assembling the lid member 21 to the case main body 14 after assembling the agitating paddle 16 to the case main body 14, the insertion projection 124 of the lid member 21 is inserted into the insertion groove 28. Accordingly, it becomes possible to prevent the toner from leaking through the insertion groove 28.

By the way, when the lid member 21 is assembled to the case main body 14, if the lid member 21 may be erroneously attached to the case main body 14 in a reversed posture in the left and right direction relative to an original correct posture (a posture in which the insertion projection 124 is on the left end portion of the lid member 21 and the contacting projection 125 is on the right end portion of the lid member 21), the lid member 21 may not close the opening 22 of the case main body 14 surely.

However, in the present embodiment, the insertion groove 28, which is formed on the inner face of the right side wall 24 of the case main body 14, is not formed on the inner face of the left side wall 30 of the case main body 14. Then, if the lid member 21 is attached to the case main body 14 while inserting the insertion projection 124 into the insertion groove 28, a posture of the lid member 21 in the left and right direction is automatically matched with the correct original posture so that the above incorrect attachment of the lid member 21 can be prevented.

In the present embodiment, especially, the contacting projection 125 of the lid member 21 is arranged asymmetrically to the insertion groove 28 and the insertion projection 124 around the center point C of the opening 22 of the case main body 14 (refer to FIG. 21 and other figures). Accordingly, if the lid member 21 may be attached to the case main body 14 in the reversed posture in the left and right direction relative to the original correct posture, the contacting projection 125 cannot be inserted into the insertion groove 28 and then interferes with the case main body side flange 23. This prevents the attachment of the lid member 21 to the case main body 14. Accordingly, the above incorrect attachment of the lid member 21 can be prevented more surely.

The embodiment shows a case where the agitating paddle 16 is assembled to the case main body 14 by using the insertion groove 28. On the other hand, in other embodiments, a rotating member, such as the conveying screw 17, other than the agitating paddle 16 may be assembled to the case main body 14 by using the insertion groove 28.

By the way, when the toner replenishment operation is carried out as described above, if the first transmitting member 81 may be fallen (tilted), the engagement of the outer gear 86 of the first transmitting member 81 with the driving gear train 147 and the engagement of the inner gear 87 of the first transmitting member 81 with the small diameter gear 98 of the connecting member 83 become unstable. Then, the rotation transmitting mechanism 18 may not transmit the rotation of the driving gear train 147 to the agitating paddle 16 and the conveying screw 17 securely.

However, in the present embodiment, since the first transmitting member 81 is supported by the support wall part 104 formed on the cover main body 100 of the cover 20, the first transmitting member 81 can be prevented from falling (tilting) securely. Accordingly, the rotation transmitting mechanism 18 can transmit the rotation of the driving gear train 147 to the agitating paddle 16 and the conveying screw 17 securely.

Especially, in the present embodiment, the support wall part 104 is inserted into the space between the pair of cylindrical parts 88, 89 formed on the first transmitting member 81. This makes it possible to prevent the falling (tilting) of the first transmitting member 81 securely and also to improve strength of the first transmitting member 81.

In the present embodiment, the cover 20 is configured such that the support wall part 104 protrudes leftward (inward in the left and right direction) from the guide wall part 103 formed on the cover main body 100. By using such a configuration, it becomes possible to improve strength of the guide wall part 103 in addition to the support wall part 104. Accordingly, when the toner container 6 is attached to the development device 10 and the toner container 6 rotates between the locking release position and the locking position, if a large load may be applied on the guide wall part 103, the guide wall part 103 can be prevented from being deformed or damaged.

The present embodiment shows a case where the support wall part 104 is inserted into the space between the pair of cylindrical parts 88, 89 formed on the first transmitting member 81. On the other hand, in other embodiments, the support wall part 104 may be disposed on the outer side or the inner side in the radial direction of a single cylinder part formed on the first transmitting member 81.

The embodiment has a configuration such that the guide part 34 integrally formed with the first bearing part 33 is formed on the left side wall 30 of the toner container 6. By using such a configuration, it becomes possible to improve the strength of the first bearing part 33 so that the first bearing part 33 can hold the left end portion of the agitating shaft 65 of the agitating paddle 16 surely.

In addition, the guide part 34 is configured such that the center portion in the upper and lower direction of the front facing plate 40 is curved in an arc shape along the circumferential faces of the toner filling port 32 and the cap 38. By using such a configuration, the guide part 34 can be disposed near the toner filling port 32 and the cap 38 as close as possible so that a freedom in layout of the guide part 34 can be heightened.

As described above, by forming the first bearing part 33 integrally with the guide part 34, it becomes possible to improve the strength of the guide part 34 in addition to the first bearing part 33. Accordingly, when the toner container 6 is attached to the development device 10 and the toner container 6 is rotated between the locking release position and the locking position, if a large load may be applied to the guide part 34, the guide part 34 can be prevented from being deformed or damaged.

The present embodiment shows a case where the guide part 34 protrudes leftward (outward in the left and right direction) from the base part 31 and the connecting part 37. On the other hand, in other embodiments, the guide part 34 may protrude leftward (outward in the left and right direction) from the base part 31 only.

The embodiment has a configuration such that the cover 20 has the outward arrow 121 directing the light side (the outside in the left and right direction) on the outer face of the indicating piece 101 of the cover 20. By using such a configuration, the user can easily recognize an attachment position of the toner container 6.

Particularly, the present embodiment has a configuration such that, in a state where the toner container 6 is attached to the development device 10 at the locking release position, the outward arrow 121 of the indicating piece 101 of the cover 20 does not face the inward arrow 145 of the indicating body 144 of the development device 10 (refer to FIG. 2 and other figures), when the toner container 6 rotates from the locking release position to the locking position, the outward arrow 121 faces the inward arrow 145 (refer to FIG. 3 and other figures). By using such a configuration, it becomes possible to introduce the user to rotate the toner container 6 from the locking release position to the locking position and to prevent the user from misunderstanding that the operation to set the toner container 6 to the development device 10 is completed when the toner container 6 is attached to the development device 10 at the locking release position.

The present embodiment shows a case where the outward arrow 121 is marked on the outer face of the indicating piece 101 formed separately from the cover main body 100. On the other hand, in other embodiments, the outward arrow 121 may be directly marked on the cover main body 100.

By the way, the present embodiment has a configuration that the toner container 6 rotates between the locking release position and the locking position as described above. During the rotation of the toner container 6, if outer faces of members which constitute the development device 10 (for example, the casing 130, the replenishment shutter 131, the seal member 135 and the detecting part 136) rub on the outer face of the case main body 14, the toner may be displaced from the outer faces of the members to the outer face of the case main body 14. Then, when the toner container 6 is replaced, a user's hand may be contaminated with the toner displaced to the outer face of the case main body 14.

However, the present embodiment has a configuration that the first and second depressed parts 51, 52 are formed on the outer face of the bottom wall 44 of the case main body 14 so as to face the outer face of the members which constitute the development device 10 at intervals during the rotation of the toner container 6 (refer to FIG. 14, FIG. 15 and other figures). By using such a configuration, it becomes possible to prevent the outer faces of the members which constitute the development device 10 from rubbing on the outer face of the case main body 14. Accordingly, it becomes possible to prevent the toner from being displaced from the outer faces of the members to the outer face of the case main body 14 and then to prevent the user's hand from being contaminated with the displaced toner when the toner container 6 is replaced.

Particularly, in the present embodiment, the first depressed part 51 is formed so as to overlap with the seal member 135 and the replenishment shutter 131 in the left and right direction. Accordingly, it becomes possible to prevent the outer faces of the seal member 135 and the replenishment shutter 131 from rubbing on the outer face of the case main body 14 and to prevent the toner from being displaced from the outer faces of the seal member 135 and the replenishment shutter 131 to the outer face of the case main body 14 surely.

In addition, in the present embodiment, the second depressed part 52 is formed so as to overlap with the detecting part 136 in the left and right direction. Accordingly, it becomes possible to prevent the outer face of the detecting part 136 from rubbing on the outer face of the case main body 14 and to prevent the toner from being displaced from the outer face of the detecting part 136 to the outer face of the case main body 14 surely.

The embodiment shows a case where two depressed parts (the first depressed part 51 and the second depressed part 52) are formed on the outer face of the case main body 14. On the other hand, in other embodiments, one depressed part may be formed on the outer face of the case main body 14 or three or more depressed parts may be formed on the outer face of the case main body 14.

By the way, the present embodiment has a configuration such that the case main body 14 rotates relative to the discharge shutter 15 between the opening position and the closing position, as described above. When such a configuration is used, if the user enters his hand into a space between the outer face of the case main body 14 and the inner face of the discharge shutter 15, the user's hand may be contaminated with the toner adhered on the outer face of the case main body 14 or the inner face of the discharge shutter 15. The present embodiment prevents the contamination of the user's hand as described below.

With reference to FIG. 14 and other figures, in a state where the case main body 14 of the toner container 6 is in the closing position, the facing rib 56 of the case main body 14 does not face the inner face of the shutter main body 59 of the discharge shutter 15 and is exposed. On the other hand, with reference to FIG. 15 and other figures, in a state where the case main body 14 of the toner container 6 is in the opening position, the facing rib 56 faces the inner face of the shutter main body 59 (particularly, the inner rib 61 formed on the inner face of the shutter main body 59). Accordingly, it becomes possible to prevent the user's hand from entering the space between the outer face of the case main body 14 and the inner face of the discharge shutter 15 in the state where the case main body 14 is in the opening position and to prevent the user's hand from being contaminated with the toner adhered on the outer face of the case main body 14 and the inner face of the discharge shutter 15.

The present embodiment shows a case where the facing rib 56 includes the first plate parts 57 and the second plate part 58. On the other hand, in other embodiments, the facing rib 56 may include either one of the first plate parts 57 and the second plate part 58.

Although the present embodiment was described in a case where configurations of the disclosure are applied to the printer 1, in other embodiments, the configurations of the disclosure may be applied to another image forming apparatus, such as a copying machine, a facsimile, multifunctional peripheral or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A toner case comprising:

a case main body in which a toner is contained;

a rotating member which is disposed in the case main body and is rotatable around a rotation axis;

a transmitting member which rotates along an outer face of a side wall of the case main body on one side in a direction of the rotation axis so as to transmit a rotation to the rotating member; and a cover which covers at least a portion of the transmitting member, wherein the transmitting member includes a movable part which moves as the transmitting member rotates, and the cover has a hole part through which the movable part is exposed, wherein the cover includes:

a main wall part facing an outer face of the transmitting member;

a guide wall part protruding outward in the direction of the rotation axis from a center portion of the main wall part, a support wall part protruding inward in the direction of the rotation axis from the guide wall part and supporting the transmitting member, and the hole part is formed in the main wall part in vicinity of the guide wall part and the support wall part.

2. The toner case according to claim 1, wherein the hole part is formed in a rectangular shape and tapered toward the rotation axis.

3. The toner case according to claim 1, wherein a gear is formed on an outer circumferential face of the transmitting member, the main wall part has a notch part through which a portion of the gear is exposed, and the hole part is arranged above the notch part.

* * * * *